US007460826B2

(12) United States Patent
Tanjo et al.

(10) Patent No.: US 7,460,826 B2
(45) Date of Patent: Dec. 2, 2008

(54) IMAGE FORMING APPARATUS

(75) Inventors: Toru Tanjo, Nagano (JP); Akinobu Nakahata, Nagano (JP); Hiroaki Fukumoto, Nagano (JP); Naruya Yotsuyanagi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 400 days.

(21) Appl. No.: 11/233,530

(22) Filed: Sep. 22, 2005

(65) Prior Publication Data

US 2006/0062620 A1 Mar. 23, 2006

(30) Foreign Application Priority Data

Sep. 22, 2004 (JP) ..... 2004-274714
Sep. 30, 2004 (JP) ..... 2004-288022

(51) Int. Cl.
*G03G 15/00* (2006.01)

(52) U.S. Cl. ..... 399/401; 399/407; 399/364

(58) Field of Classification Search ..... 399/401, 399/364

See application file for complete search history.

(56) References Cited

U.S. PATENT DOCUMENTS

| | | | |
|---|---|---|---|
| 4,428,660 | A | 1/1984 | Matsumoto |
| 5,615,872 | A | 4/1997 | Mochimaru |
| 2001/0012462 | A1 | 8/2001 | Motohashi et al. |
| 2002/0114634 | A1 | 8/2002 | Ahn et al. |

FOREIGN PATENT DOCUMENTS

| | | |
|---|---|---|
| JP | 7-261471 | 10/1995 |
| JP | 8-202095 | 8/1996 |
| JP | 09-274421 | 10/1997 |
| JP | 2002-116591 | 4/2002 |
| JP | 2002-274693 | 9/2002 |
| JP | 2003-167469 | 6/2003 |
| JP | 2003-287973 | 10/2003 |

*Primary Examiner*—Daniel J Colilla
*Assistant Examiner*—Allister Primo
(74) *Attorney, Agent, or Firm*—Hogan & Hartson LLP

(57) ABSTRACT

A housing body includes a first part forming a part of a first transporting path in which a medium is transported. An image forming unit is accommodated in the housing body and is adapted to form an image onto at least one face of the medium. A door cover is attached to the housing body, and the door cover includes a second part adapted to face the first part when the door cover is closed, thereby forming the part of the first transporting path together with the first part. A double-sided printing unit is detachably mounted to the second part and includes a second transporting path. The second transporting path is connected to the first transporting path and is adapted to transport the medium while turning inside out, so that the image forming unit forms images on both sides of the medium.

6 Claims, 23 Drawing Sheets

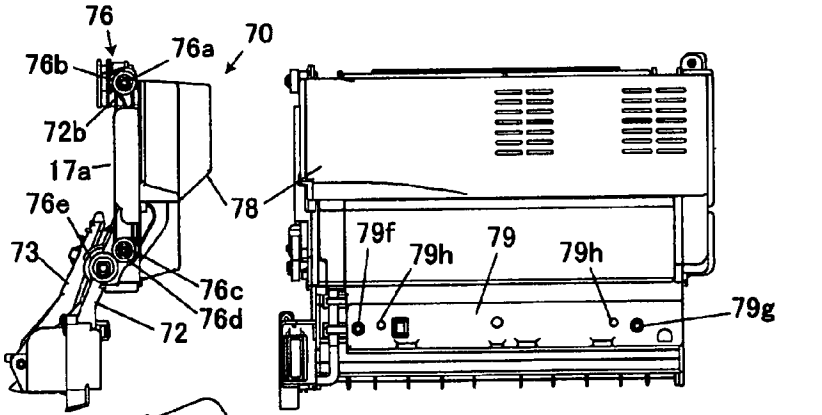
FIG. 2A
FIG. 2B
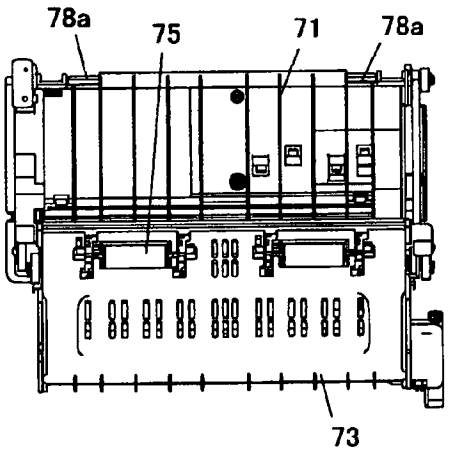
FIG. 2C
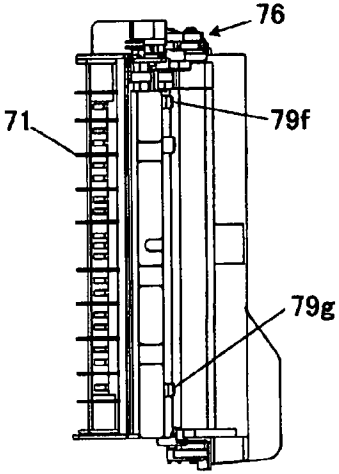
FIG. 2E
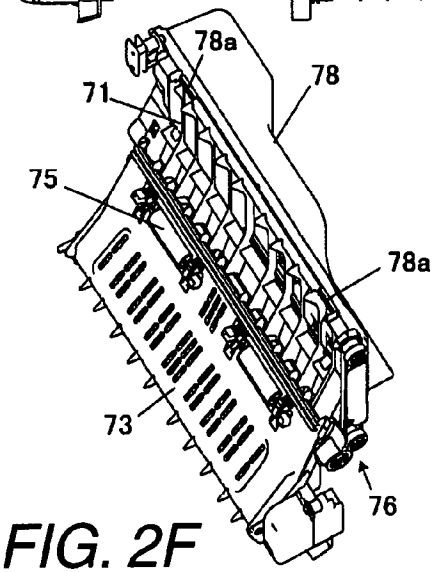
FIG. 2F
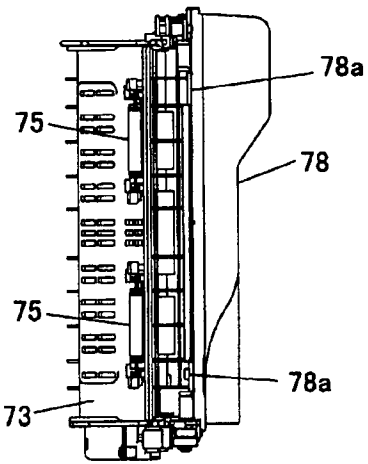
FIG. 2D

IMAGE FORMING APPARATUS

BACKGROUND OF THE INVENTION

The present invention relates to an image forming apparatus to which a double-sided printing unit can be detachably mounted and in which a medium jammed therein can be easily removed.

There has been known an image forming apparatus configured such that a double-sided printing unit having a double-sided image forming function can be mounted to a side part of a main body of the image forming apparatus in place of a transporting unit dedicated for forming a single-sided image so as to selectively provide a double-sided image forming function in accordance with user's desire (see, e.g., JP-A-2002-116591). Of the image forming apparatus, the transporting unit has rollers that constitute a paper-transporting path for forming an image on a single face of a medium.

In addition, each of the double-sided printing unit and the transporting unit has a manual paper-feeding unit.

In the above-described related-art image forming apparatus, when the double-sided image forming function is required by a user, the double-sided printing unit is mounted to the side part of the main body in place of the transporting unit.

Therefore, when the double-sided printing unit is mounted, the transporting unit is no use.

In addition to having the rollers forming the paper-transporting path for formation of an image on a single side, the transporting unit has the manual paper-feeding unit. Accordingly, the manual paper-feeding unit goes to great waste.

An image forming apparatus has, e.g., a fixing unit for fixing a toner image on a medium. The fixing unit has a first member and a second member which can nip a medium therebetween, and a pressing member for pressing the second member against the first member; and fixes a toner image on the medium nipped between the first member and the second member that is pressed by the pressing member.

In the image forming apparatus, during the course of a medium passing between the first member and the second member, a medium jam sometimes occurs. For the purpose of removing the thus-jammed medium, a door cover is provided in the image forming apparatus. Accordingly, a user, or the like, opens the door cover and removes the medium jammed in the image forming apparatus.

However, even when the door cover is opened by a user, in a condition where the second member is pressed against the first member by the pressing member, since the medium is nipped between the first member and the second member, removal of the medium jammed in the image forming apparatus encounters difficulty. To this end, an image forming apparatus has a connecting member for connecting the door cover and the fixing unit, and releasing a pressure exerted by the pressing member in association with opening motion of the door cover. By virtue of the configuration, when the door cover is opened, the pressure exerted on the second member by the pressing member is released, thereby facilitating removal of the jammed medium. (see, e.g., JP-A-2003-287973)

Meanwhile, the pressure exerted on the second member by the pressing member is desirably released before the door cover becomes fully opened. The reason therefor is that a user, or the like, sometimes attempts to remove a jammed medium in a state where the door cover is half-open before being fully opened.

Meanwhile, when the connecting member releases the pressure on the second member exerted by the pressing member, the pressing force of the pressing member serves as a resistance. Thus, the resistance is applied in a direction that opens the door cover, thereby preventing the door cover from bursting open. However, when the pressure is released before the door cover becomes fully open, the resistance against the opening motion of the door cover no longer acts after the release of the pressure. As a result, the door cover sometimes bursts open. When the door cover bursts open, a large impact is imparted on the image forming apparatus, which may adversely affect other components, or the like. Therefore, the impact imparted on the image forming apparatus upon opening of the door cover is desirably suppressed.

SUMMARY

Advantages of the present invention is to provide an image forming apparatus which is capable of reducing the extent of redundancy resulting from mounting of a double-sided printing unit having been selected by a user, and which offers facilitated removal of a jammed medium by a user and suppresses an impact imparted on the image forming apparatus at the time the door cover is opened.

According to the present invention there is provided:

an image forming apparatus comprising: a housing body including a first part forming a part of a first transporting path in which a medium is transported; an image forming unit accommodated in the housing body and adapted to form an image onto at least one face of the medium; a door cover attached to the housing body, the door cover including a second part adapted to face the first part when the door cover is closed, thereby forming the part of the first transporting path together with the first part; and a double-sided printing unit detachably mounted to the second part and including a second transporting path, the second transporting path connected to the first transporting path and adapted to transport the medium while turning inside out so that the image forming unit forms images on both sides of the medium.

According to an aspect of the invention, the double-sided printing unit is mounted to the door cover which originally forms the side face of the apparatus main body. Thus, a transporting unit dedicated for forming a single-sided image and the door cover itself do not go to waste.

Furthermore, the double-sided printing unit is mounted to the inside of rather than to the outside of the door cover. Accordingly, as compared with a case in which the double-sided printing unit is mounted to the outside of the door cover, a paper-transporting path used during formation of images on double sides can be configured to be short, whereby a double-sided printing can be performed speedily.

The image forming apparatus according to the invention may have the following structure in addition to the apparatus described above. More specifically, the first part is provided with a first roller, the first roller faces the first transporting path, the second part includes a space for mounting the double-sided printing unit and is provided with a second roller at a portion other than the space, the second roller faces the first transporting path, and the space is adapted to receive a covering member in pace of the double-sided printing unit when the image forming apparatus is configured to perform only a single-sided printing.

According to an aspect of the invention, only the covering member for forming a single-sided image would go to waste when the double-sided printing unit selected by the user is mounted. Furthermore, since the covering member has no rollers, the extent of waste can be minimized.

According to the present invention there is provided:

an image forming apparatus comprising: a housing body including a first part, a second part and a first transporting path in which a medium is transported; an image forming unit accommodated in the housing body and adapted to form image onto at least one face of the medium; a double-sided printing unit detachably mounted to the first part and including a second transporting path, the second transporting path connected to the first transporting path and adapted to transport the medium while turning inside out so that the image forming unit forms images on both sides of the medium; and a manual feeding unit mounted to the second part and including a third transporting path connected to the first transporting path, the manual feeding unit adapted to manually feed the medium to the image forming unit, wherein the double-sided printing unit is operably detached from the first part independent from the manual feeding unit.

According to an aspect of the invention, the manual feeding unit can be prevented from being of no use when the double-sided printing unit selected by the user is mounted.

According to the present invention there is provided:

an image forming apparatus comprising: a housing body including a first part and a first transporting path in which a medium is transported; an image forming unit accommodated in the housing body and adapted to form an image onto at least one face of the medium; a door cover including a second part attached to the housing body, the door cover including a third part and a fourth part, a double-sided printing unit detachably mounted to the forth part and including a second transporting path, the second transporting path connected to the first transporting path and adapted to transport the medium while turning inside out so that the image forming unit forms images on both sides of the medium; and a manual feeding unit comprised of the first part and the third part, the manual feeding unit including a third transporting path connected to the first transporting path and adapted to manually feed the medium to the image forming unit, wherein the third part is arranged between the second part and the fourth part.

According to an aspect of the invention, the double-sided printing unit is mounted to the door cover which originally forms the side face of the apparatus main body. Thus, a transporting unit dedicated for forming a single-sided image as well as the door cover itself can be prevented from being of no use. The manual feeding unit would not go to waste, as well.

The image forming apparatus according to the invention may have the following structure in addition to the apparatus described above. More specifically, the forth part is adapted to face the housing body when the door cover is closed.

According to the present invention there is provided:

an image forming apparatus comprising: a housing body; a door cover attached to the housing body; a fixing unit accommodated in the housing body and adapted to fix an image onto a medium, the fixing unit comprising: a first member; a second member adapted to nip the medium together with the first member when the door cover is closed; and a pressing member adapted to press the second member against the first member when the door cover is closed; a first connecting unit connecting with the door cover and the fixing unit and being associated with opening and closing motion of the door cover, the first connecting unit comprising: a releaser adapted to cause the pressing member not to press the second member in association with the opening motion of the door cover; a slider adapted to slide on the releaser in association with the opening motion of the door cover.

According to an aspect of the invention, there can be realized an image forming apparatus which offers facilitated removal of a jammed medium by a user or the like, as well as suppression of an impact imparted on the image forming apparatus at the time the door cover is opened.

The image forming apparatus according to the invention may have the following structure in addition to the apparatus described above. More specifically, the first member includes a rotatably first roller, and the second member includes a rotatably second roller.

According to an aspect of the invention, a pressing force exerted on the second member by the pressing member is desirably set to a large value so as to enhance fixing force. Meanwhile, when the pressing force is large, the need for removal of a medium jammed in the apparatus further increases. Accordingly, when an image forming apparatus is provided with the above-described pressure-releasing structure, there is yielded an effect of realizing an image forming apparatus offering facilitated removal of a jammed medium by a user, or the like, more effectively.

The image forming apparatus according to the invention may have the following structure in addition to the apparatus described above. More specifically, the pressing member includes a spring.

According to an aspect of the invention, since adjustment of a pressing force can be performed easily, the pressing member can press the second member with an appropriate pressing force.

The image forming apparatus according to the invention may have the following structure in addition to the apparatus described above. More specifically, the releaser includes a plurality of pivotably link members being connected to each other.

The image forming apparatus according to the invention may have the following structure in addition to the apparatus described above. More specifically, the slider is comprised of a metal material.

According to an aspect of the invention, since a friction caused by the slider sliding on the releaser increases, a braking effect produced at the time when the door cover is opened is exerted more remarkably. Therefore, when the slider is comprised of a metal, the impact imparted on the image forming apparatus upon opening of the door cover can be suppressed more effectively.

The image forming apparatus according to the invention may have the following structure in addition to the apparatus described above. More specifically, the image forming apparatus further comprises a second connecting unit having same constitution as the first connecting unit.

According to an aspect of the invention, since the door cover can be supported stably, the impact imparted on the image forming apparatus upon opening of the door cover can be suppressed more effectively.

The image forming apparatus according to the invention may have the following structure in addition to the apparatus described above. More specifically, the door cover includes a feeding unit feeding the medium.

According to an aspect of the invention, the door cover is increased in weight. Since the thus-increased weight of the door cover acts in the direction that opens the door cover, the possibility that the door cover bursts open with higher momentum increases. Therefore, when the door cover includes the feeding unit, the effect of suppressing the impact imparted on the image forming apparatus upon opening of the door cover can be exerted more effectively.

The image forming apparatus according to the invention may have the following structure in addition to the apparatus described above. More specifically, the housing body includes a first body portion and a second body portion, and the door cover includes a first cover portion attached to the first body portion and a second cover portion detachably attached to the second body portion.

According to an aspect of the invention, there arises the possibility that the door cover bursts open with still higher momentum under the force of gravity, whereby the impact exerted on the image forming apparatus may be increased. Therefore, when the door cover has the coupling section, which attached to the apparatus main body, at the vertically-lower portion and opens/closes about the coupling section serving as a pivot, the effect of suppressing the impact imparted on the image forming apparatus upon opening of the door cover can be exerted more effectively.

The image forming apparatus according to the invention may have the following structure in addition to the apparatus described above. More specifically, the releaser includes a first part, a second part and a third part, aligned in this order, a first section between the first part and the second part is larger than a second section between the second part and the third part, the slider slides on the first section after the door cover is open until the releaser causes the pressing member not to press the second member, and the slider slides on the second section after the releaser causes the pressing member not to press the second member until the door cover fully opens.

According to an aspect of the invention, until the pressure is released by the releaser, the resistance produced by sliding of the slider can be prevented, thereby enabling smooth opening of the door cover.

The image forming apparatus according to the invention may have the following structure in addition to the apparatus described above. More specifically, the image forming apparatus is adapted to be connected to a computer.

BRIEF DESCRIPTION OF THE DRAWINGS

FIGS. 2A through 2F are views illustrating a double-sided printing unit 70, where FIG. 2A is a front view, FIG. 2B is a right side view, FIG. 2C is a left side view, FIG. 2D is a plane view, FIG. 2E is a bottom view, and FIG. 2F is a perspective view.

FIG. 6A is a perspective view, and FIG. 6B is a front view.

FIG. 7A is a right side view, and FIG. 7B is a left side view.

DETAIL DESCRIPTION OF PREFERRED EMBODIMENTS

Hereinafter, a first embodiment of an image forming apparatus according to the present invention will be described by reference to FIGS. 1 to 10.

Figure 1:
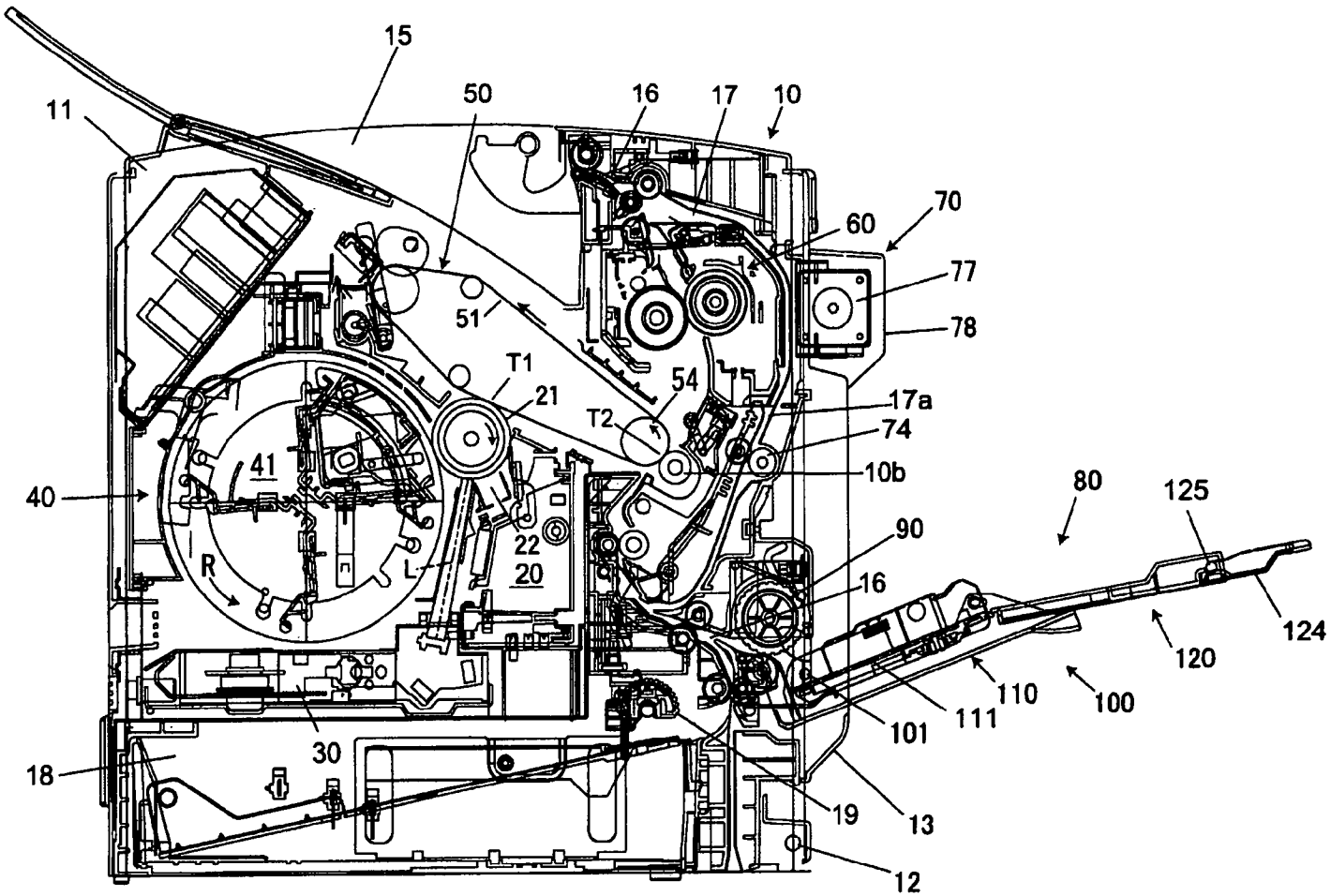
FIG. 1 is a schematic front view illustrating an internal configuration of an embodiment of an image forming apparatus according to the invention.

As shown in FIG. 1, the image forming apparatus is a color-image forming apparatus that can perform paper-transporting of a sheet of A4 size (including a letter size), and form a color image on each side of the sheet. The image forming apparatus has a case 11, an image carrier unit 20 which is housed inside the case 11, an exposure unit 30, a development device 40, an intermediate transfer unit 50, and a fixing unit 60.

A frame (not shown) of an apparatus main body 10 is disposed on the case 11, and the respective units, and the like, are attached to this frame.

The image carrier unit 20 has a photosensitive member 21 having a photosensitive layer on the peripheral surface thereof, and a corona electrifying device (a scorotron electrifying device) 22 serving for uniformly electrifying the peripheral surface of the photosensitive member 21. The peripheral surface of the photosensitive member 21 having been uniformly electrified by the corona electrifying device 22 is selectively subjected to exposure with use of a laser beam L radiated from the exposure unit 30, to thus form an electrostatic latent image. The development device 40 imparts toner, serving as a developing agent, onto the electrostatic latent image, to thus obtain a visible image (a toner image). A primary transfer section T1 performs primary transfer of the toner image to an intermediate transfer belt 51 of the intermediate transfer unit 50. Furthermore, a secondary transfer section T2 performs secondary transfer of the image onto paper, which is an object of the transfer operation.

Inside the case 11, there are disposed a transporting path 16 for transporting paper on a single side of which an image has been formed by the secondary transfer section T2 toward a paper-output section (a paper-output tray section) 15 on the upper face of the case 11, and a return path 17 for causing the paper having been transported toward the paper-output section 15 by way of the transporting path 16 to switch back, thereby returning the paper toward the secondary transfer section T2 so as to form an image also on the other side.

Reference numeral 70 denotes a double-sided printing unit configured so as to be detachable from the apparatus main body. Mounting of this double-sided printing unit 70 completes the return path 17.

In the lower portion of the case 11, there are disposed a paper transport cassette 18 for stacking and retaining a plurality of sheets of paper thereon, and a paper transport roller 19 for transporting a single sheet of the paper at a time toward the secondary transfer section T2.

Provided below the double-sided printing unit 70 are a multi-purpose tray 100 forming a manual paper feeding unit 80. A paper feed roller 90 for feeding a single sheet of paper having been set in the multi-purpose tray 100 at a time, is disposed in the apparatus main body (more specifically, to a side-face cover which will be described in detail later).

The development device 40, which is a rotary-type development device, is formed such that developing cartridges (not shown) of respective colors in which yellow toner, cyan toner, magenta toner, and black toner are respectively housed are detachably mounted to a rotary member main body 41. The rotary member main body 41 rotates by a pitch angle of 90 degrees in a direction indicated by an arrow R, whereby a developing roller (not shown) provided in each of the developing cartridges is selectively brought into contact with the photosensitive member 21. Thus, selective development of the surface of the photosensitive member 21 is achieved.

The exposure unit 30 radiates the laser beam L toward the photosensitive member 21.

The intermediate transfer unit 50 has a unit frame (not shown), a drive roller 54 which is rotatably supported on this frame, and the intermediate transfer belt 51 which extends in a tensioned manner by means of being wrapped around a plurality of driven rollers. The intermediate transfer belt is rotationally driven in the direction indicated by the arrow in the drawing. The primary transfer section T1 is formed at a contact portion between the photosensitive member 21 and the intermediate transfer belt 51, and the secondary transfer section T2 is formed at a nip portion between the drive roller 54 and a secondary transfer roller 10*b* which is disposed on the main body side.

The secondary transfer roller 10*b* can be brought into contact with and separated from the drive roller 54 (i.e., brought into contact with and separated from the intermediate transfer belt 51), and at the time of contact, the secondary transfer section T2 is formed.

Accordingly, for formation of a color image, in a state where the secondary transfer roller 10*b* is separated from the intermediate transfer belt 51, toner images of a plurality of colors are superimposed on the intermediate transfer belt 51 to thus form a color image, and thereafter, the secondary transfer roller 10*b* is brought into contact with the intermediate transfer belt 51. Paper is transported to a contact portion (the secondary transfer section T2) thereof, whereby the color image (the toner image) is transferred (thereby attaining secondary transfer) onto the paper from the intermediate transfer belt 51.

The paper, on which the toner image has been transferred, passes through the fixing unit 60, whereby the toner image is fixed in a fusing manner and is fed toward the paper-output tray section 15.

Paper transporting to an image forming section is selectively performed by means of selecting either the paper transport cassette 18 or the multi-purpose tray 100.

Usually, plain paper or the like is regularly set in the paper transport cassette 18, in contrast, in the multi-purpose tray 100, a variety of types of paper are set, as required. More specifically, in the multi-purpose tray 100, plain paper, thick paper, a postcard, an envelope, an OHP sheet, or other recording material is set as required by a user.

On the side face of the apparatus main body 10, a cover (in the present embodiment, a side-face cover) 13 is openably attached via a shaft 12. The manual paper feeding unit 80 is disposed on the side-face cover 13.

The manual paper feeding unit 80 has the paper feed roller 90, and the multi-purpose tray 100 for supporting paper to be fed by means of the paper feed roller 90.

The multi-purpose tray 100 has a first tray 110 which includes a lifting plate 111, and a second tray 120. The lifting plate 111 supports a front portion of paper, and presses the front portion of the paper against the paper feed roller 90. The second tray 120 is coupled to the rear of the first tray 110, thereby supporting the rear portion of the paper. A tilt angle of the second tray 120 with respect to the horizontal is smaller than that of the first tray 110.

An auxiliary tray 124 is coupled to the rear of the second tray 120 in a pivotable manner, by means of a shaft 125. The auxiliary tray 124 can pivot 180 degrees on the shaft 125, and can be housed on the second tray 120 by means of being pivoted 180 degrees.

In addition, the second tray 120 can be housed in the first tray 110 (below the lifting plate 111) by means of a sliding operation.

The multi-purpose tray configured as above is mounted by means of a shaft 101 so as to be openably in relation to the side-face cover 13 of the apparatus main body 10. Thus, by means of being caused to pivot on the shaft 101 in a state in which the auxiliary tray 124 is housed on the second tray 120 and in which the second tray 120 is housed in the first tray 110, the multi-purpose tray 100 can be stored flush with the side-face cover 13 (see FIGS. 4 and 10).

As shown in FIGS. 1 through 2F, the double-sided printing unit 70 has a return path 17*a* which is in communication with the return path 17 disposed on the above-mentioned apparatus main body 10, thereby completing a return path, paper guides 71, 72, and 73 forming the return path 17*a*, a paper-transporting drive roller 74 (see FIG. 1) disposed on the return path 17*a*, a driven roller 75 which is brought into contact with the paper-transporting drive roller 74, to thus be driven, a motor 77 (see FIG. 1) which drives the paper-transporting drive roller 74 by way of a drive mechanism 76; and a case 78 for covering the respective sections.

As shown in FIG. 2A, the drive mechanism 76 drives the paper-transporting drive roller 74 with use of the motor 77 by way of a transfer mechanism (not shown). The drive mechanism 76 has a gear 76*e* that is coaxial with the paper-transporting drive roller 74. A timing pulley 76*c* is fixed on an axis that also carries a gear 76*d* that is coupled with and driven by the gear 76*e*, and drives a timing pulley 76*a* via a timing belt 72*b*. The gear 76*b* is fixed on an axis that also carries the timing pulley 76*a*, and is coupled to a gear (not shown) which drives paper-output rollers R6 and R7 of the main body 10.

The driven roller 75 is rotatably disposed on the paper guide 73.

The double-sided printing unit 70 configured as above is detachably mounted to the apparatus main body 10 by a user, as will be described later.

Figure 3:
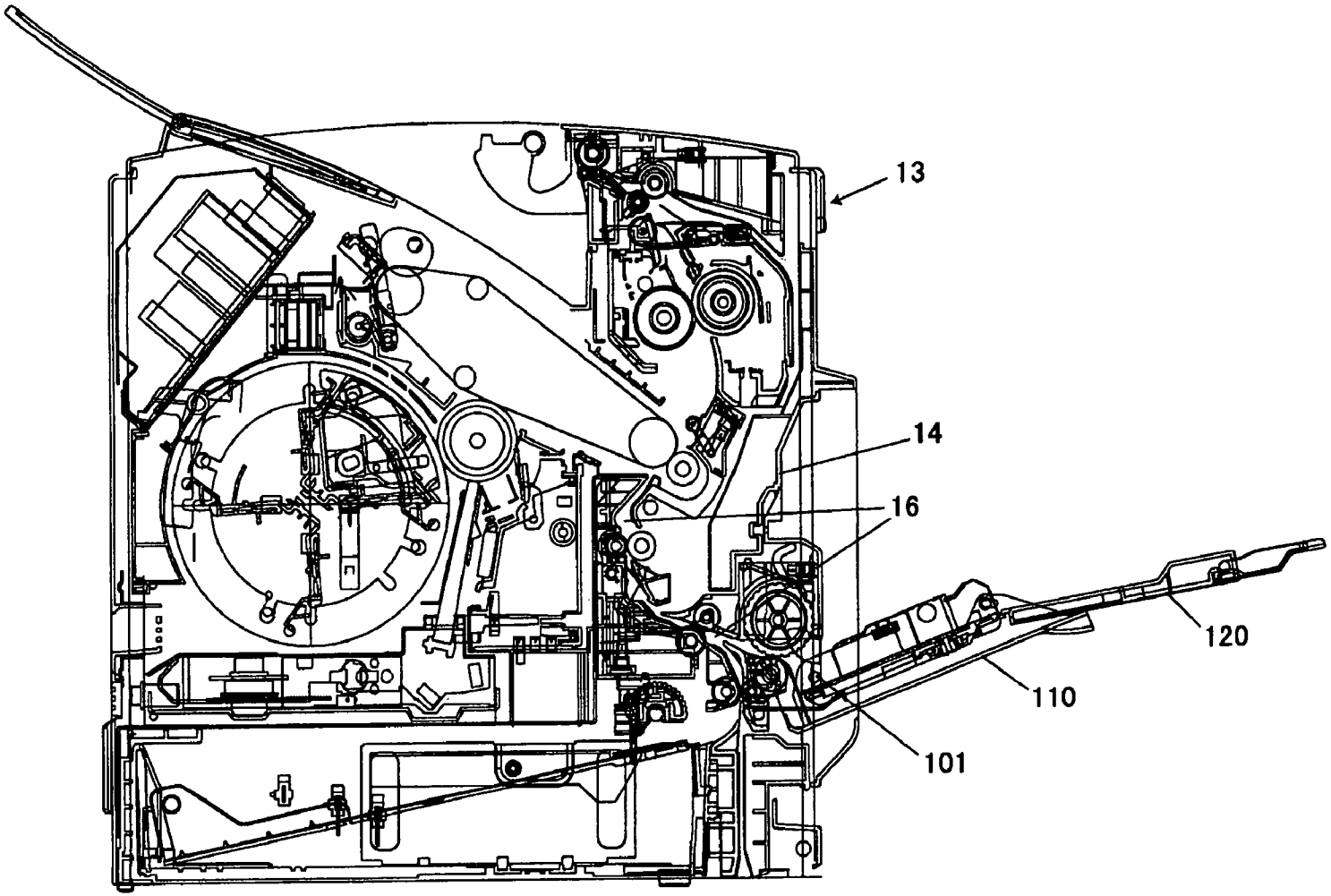
FIG. 3 is a schematic front view illustrating an internal configuration of the image forming apparatus in a state where a covering member 14 is mounted in place of the double-sided printing unit 70.
Figure 4:
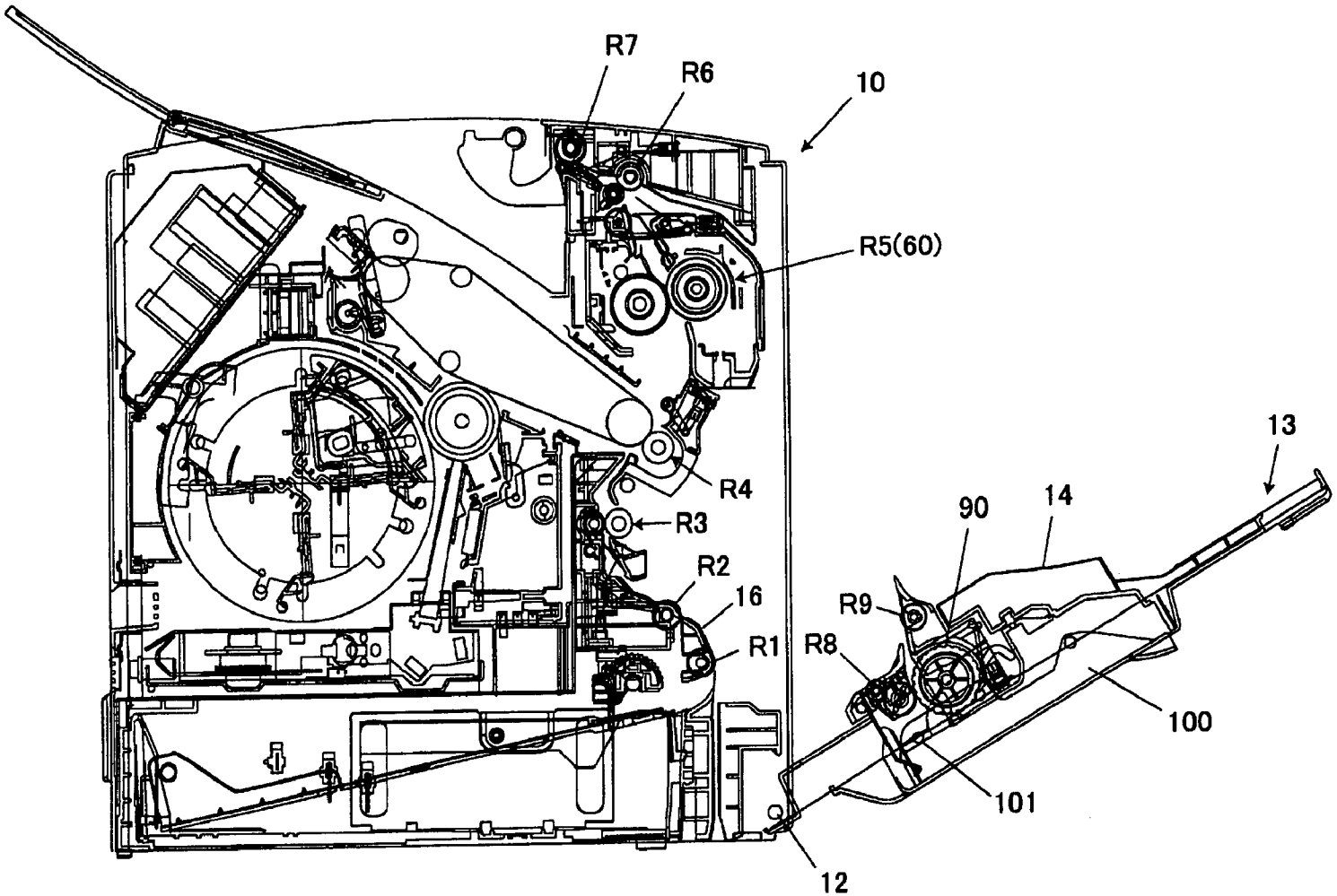
FIG. 4 is a front view of FIG. 3 in a state where the side-face cover 13 is open.

As shown in FIGS. 3 and 4, and as described above, the multi-purpose tray 100 can be housed in the side-face cover 13 by means of being caused to pivot on the shaft 101 in a state where the second tray 120 is housed in the first tray 110.

The paper feed roller 90 is disposed in the side-face cover 13.

In addition, as is apparent from FIGS. 3 and 4, the paper-transport path 16 for formation of an image on a single side comprises only rollers R1 through R7 disposed in the apparatus main body 10 and rollers R8 and R9 disposed in the side-face cover 13. The covering member 14 has no rollers for transporting paper.

Figure 5:
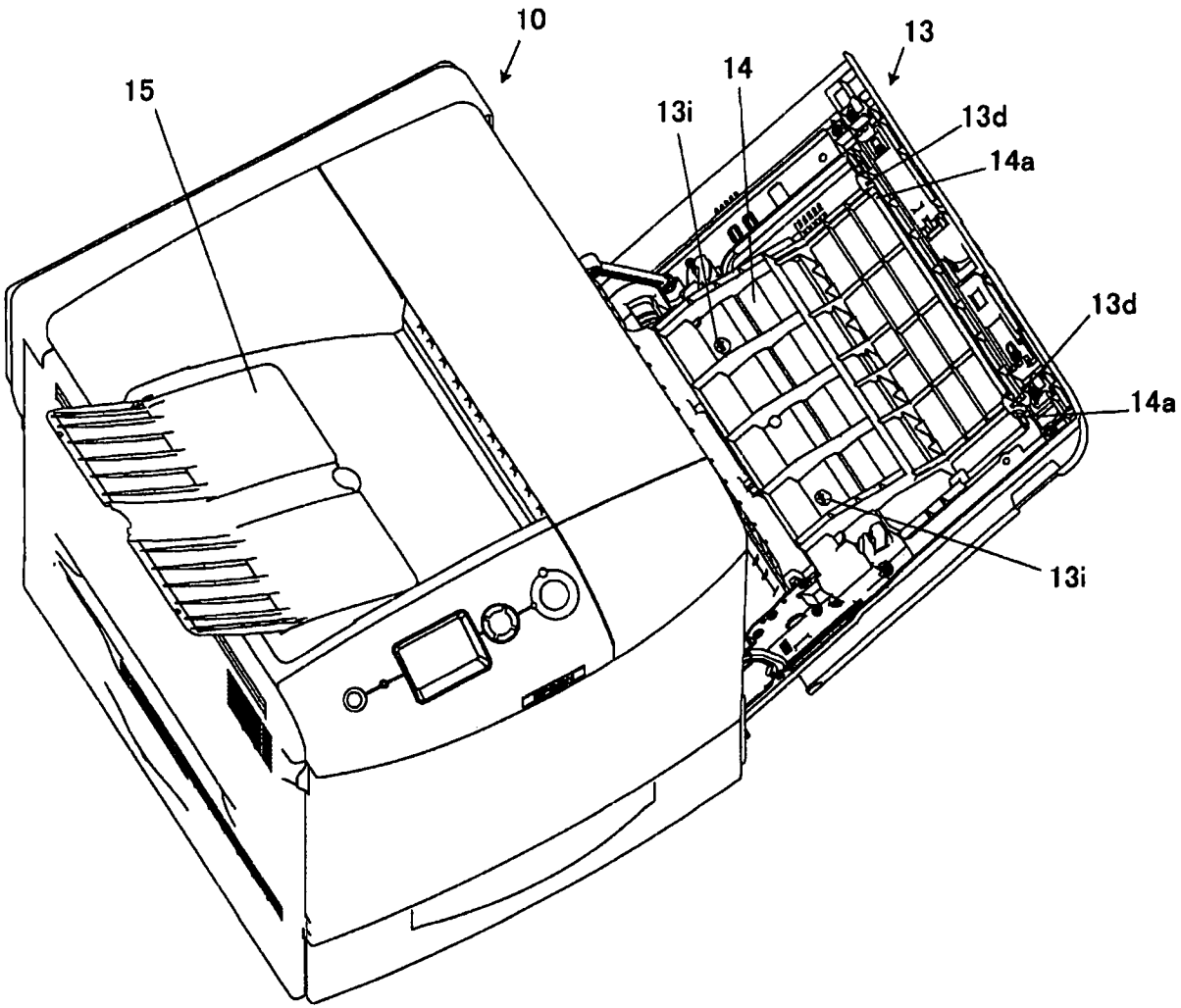
FIG. 5 is a perspective view of FIG. 3 in a state where the side-face cover 13 is open.
Figure 6B:
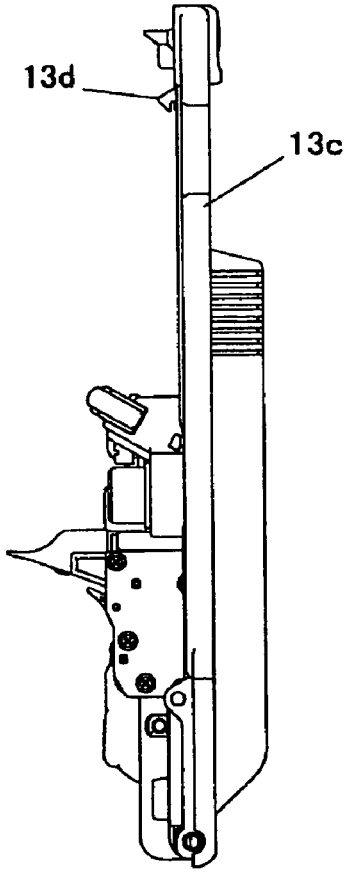
FIGS. 6A and 6B are views illustrating the side-face cover 13, where
Figure 6A:
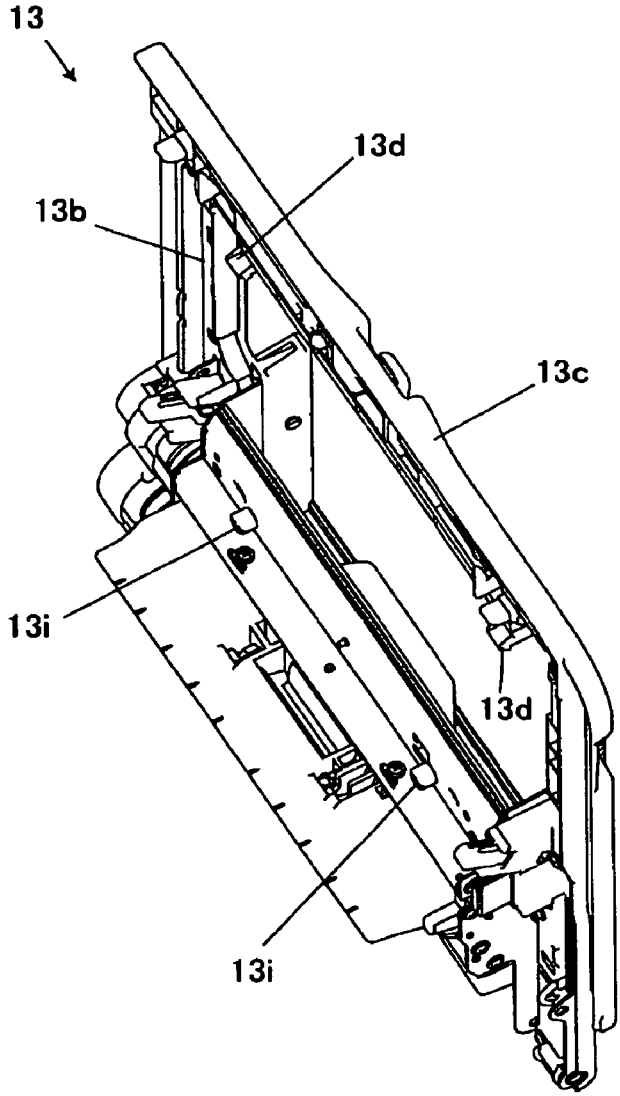

As shown in FIGS. 3 to 5, the covering member 14 is mounted to the side-face cover 13. The mounting state thereof will be described hereinbelow.

As shown in FIGS. 6A to 8, the side-face cover 13 has a substantially square geometry overall, and has an opening 13*a* formed in the upper portion.

Figure 7A:
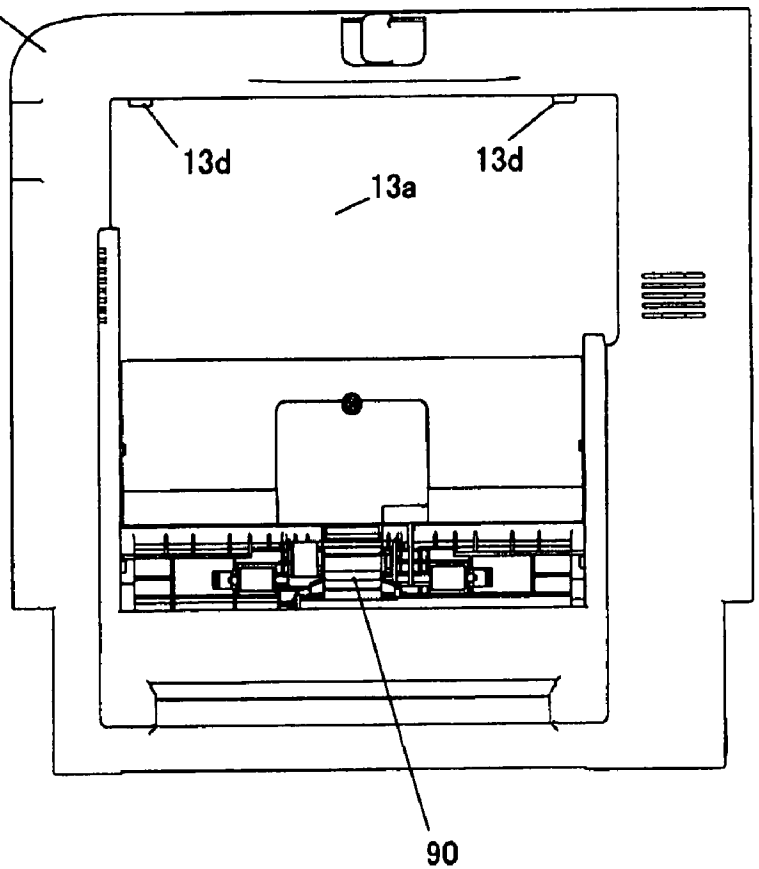
FIGS. 7A and 7B are views illustrating the side-face cover 13, where
Figure 7B:
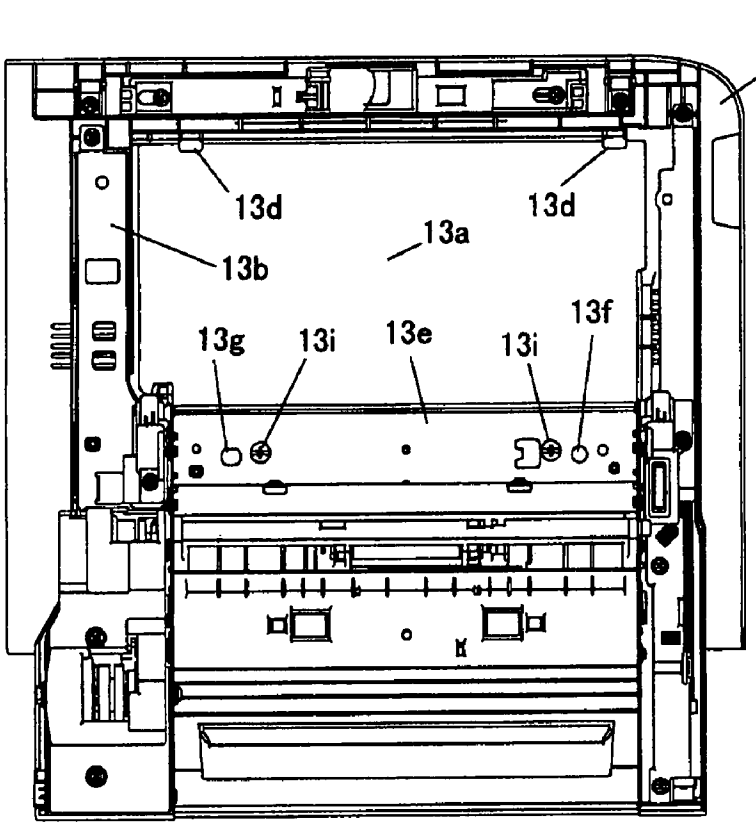

The side-face cover 13 has a sheet-metal frame 13*b* (FIG. 7B) having a substantially H-shaped geometry, and a cover 13*c* for covering the surface side (the right-side face side of the image forming apparatus) of the sheet-metal frame 13*b*. The above-mentioned paper feed roller 90, and the like, are mounted to the sheet-metal frame 13*b*. A pair of hook sections 13*d* are disposed on upper portions inside of the door cover 13*c*, one on the right side, and the other on the left side. In addition, as shown in FIG. 7B, in a horizontal section 13*e* of the sheet-metal frame 13*b*, there are formed a positioning hole 13*f* for use with the covering member 14, and a positioning hole 13*g* for the double-sided printing unit 70, screw holes 13*h*, 13*h* (see FIG. 8), and screws 13*i*, 13*i* to be screwed in the screw holes 13*h*, as will be described later. Meanwhile, the hole 13*g*, which is one of the positioning holes, is an elongated hole.

As shown in FIG. 5, opposite ends 14*a* of the upper portion of the covering member 14 are engaged on the hook sections 13*d* on the side-face cover 13, and the lower portion 14*d* of the door cover 14 is fastened with use of the screws 13*i*, whereby the door cover 14 is attached to the side-face cover from inside the side-face cover 13.

Meanwhile, projections (although not shown, projections similar to projections 79*f*, 79*g*, which will be described later) to be fit in the positioning holes 13*f*, 13*g* are formed on the outer side of the covering member 14.

For mounting of the double-sided printing unit 70 in place of the covering member 14, first, as shown in FIG. 5, the side-face cover 13 is opened, and the covering member 14 is removed from the side-face cover 13.

The covering member 14 can be removed easily by means of removing the screws 13*i*, and removing the opposite ends 14*a* of the upper portion of the covering member 14 from the hook sections 13*d*, 13*d* on the side-face cover 13.

Figure 8:
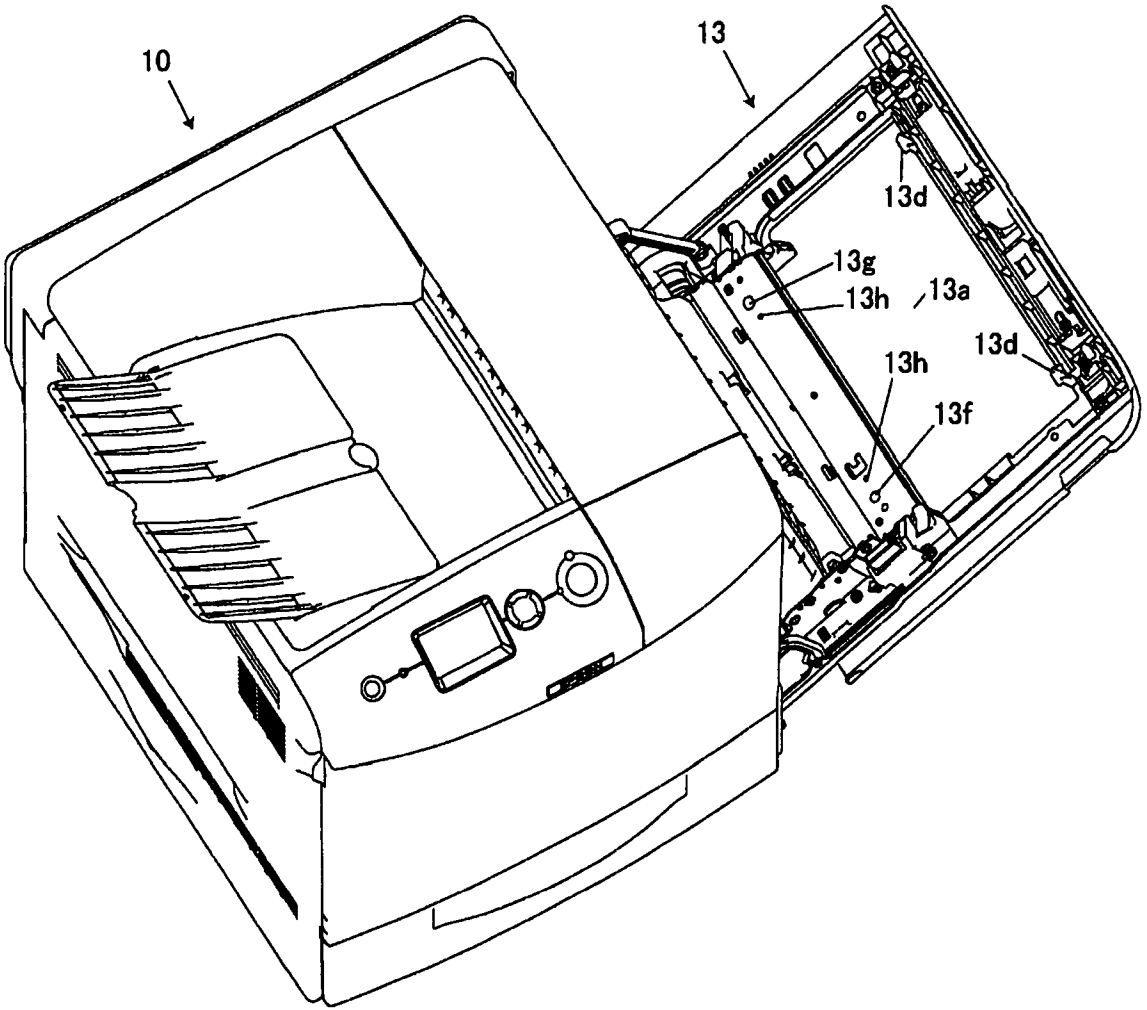
FIG. 8 is a perspective view of the side-face cover 13 of an open state where neither the covering member 14 nor the double-sided printing unit 70 is mounted to the side-face cover 13.

FIG. 8 shows a state where the covering member 14 has been removed in this manner.

Subsequently, as in the case of the covering member 14, the double-sided printing unit 70 is mounted to the side-face cover 13 from inside thereof.

Figure 9:
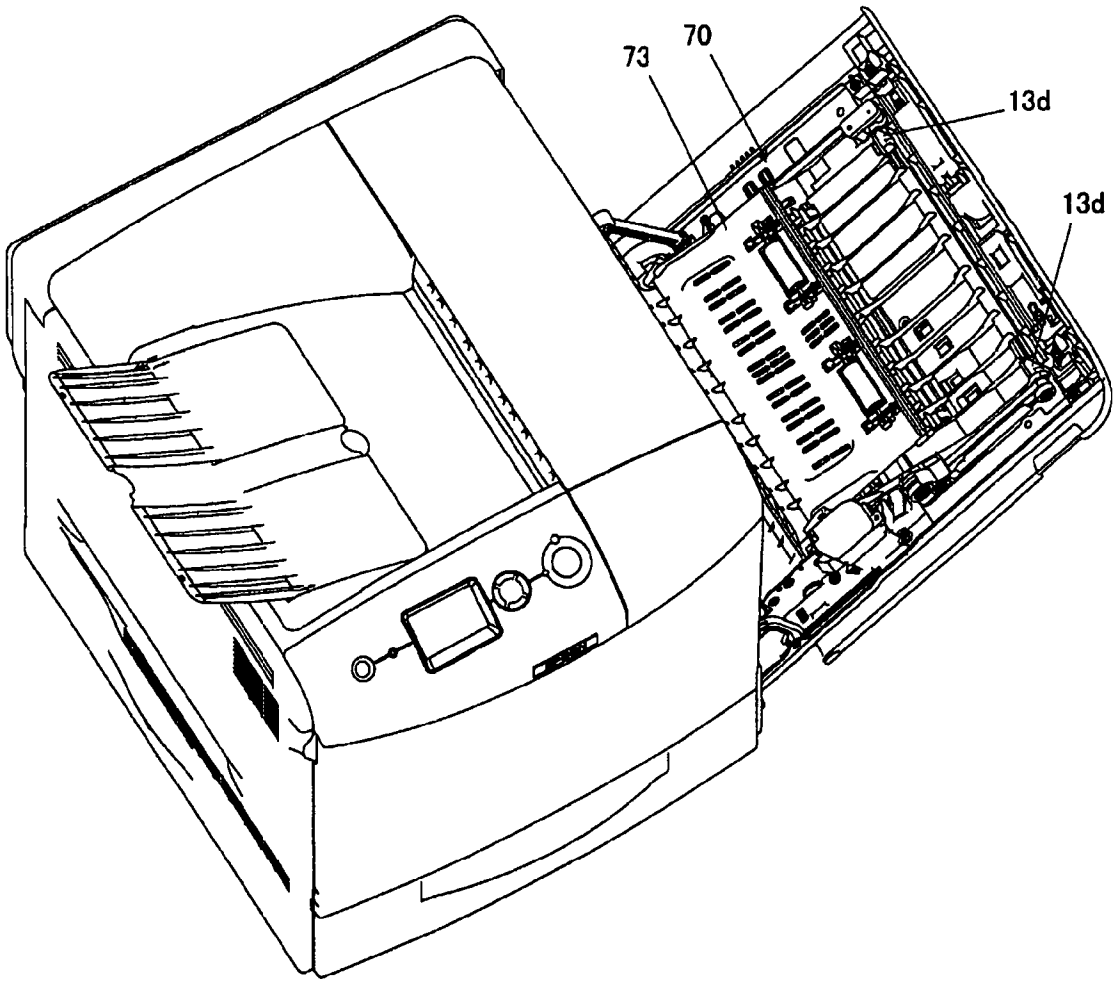
FIG. 9 is a perspective view illustrating amounted state of the double-sided printing unit 70.

More specifically, as shown in FIG. 9, opposite ends 78*a* (see FIG. 2) of the upper portion of the double-sided printing unit 70 are engaged with the hook sections 13*d* on the side-face cover 13, and the projections 79*f* and 79*g* (see FIGS. 2B and 2E) formed on the outer side of a sheet-plate frame 79 (see FIG. 2B) of the double-sided printing unit 70 are respectively fit in the positioning holes 13*f*, 13*g* (FIG. 8) in the side-face cover 13.

Figure 10:
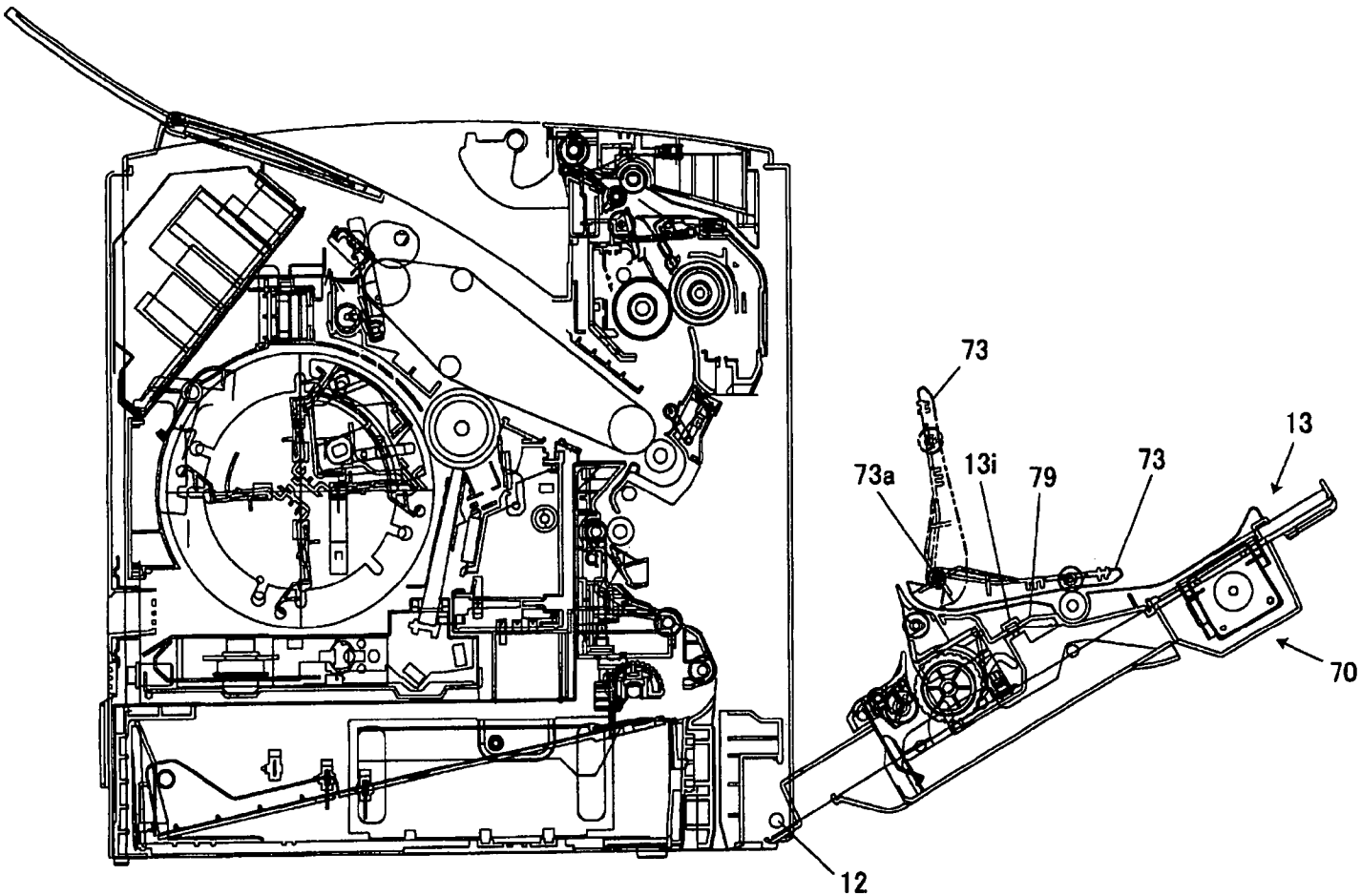
FIG. 10 is a cross-sectional view illustrating a mounted state of the double-sided printing unit 70.

Thereafter, as shown in FIG. 10, the paper guide 73 is caused to pivot on the shaft 73*a* (see a vertical line in FIG. 10). The screws 13*i* are inserted in the holes 79*h* (see FIG. 2B) in the sheet-plate frame 79 which are exposed as a result of the pivoting of the paper guide 73 and the screw holes 13*h* (see FIG. 8) in the side-face cover 13, and fastened. Thus, the double-sided printing unit 70 is attached to the side-face cover 13 from the inside thereof.

Thereafter, by means of closing the paper guide 73 as shown by the solid line in FIG. 10, and closing the side-face cover 13 on the shaft 12, there is achieved a state where double-sided image forming is enabled as has hitherto been described by reference to FIG. 1.

The above image forming apparatus yields the following working effects.

The image forming apparatus has such a configuration that the double-sided printing unit 70 is detachably mounted to the door cover 13 which is openably disposed on the side face of the apparatus main body 10 from inside the door cover 13. Accordingly, the double-sided printing unit 70 is mounted to the door cover 13 which originally forms the side face of the apparatus main body 10.

Therefore, the transporting unit dedicated for forming a single-sided image as well as the door cover itself do not go to waste.

Furthermore, the double-sided printing unit 70 is mounted from inside rather than from outside of the door cover 13. Accordingly, as compared with a case where mounting from outside, the paper-transport path 17 used during double-sided image forming can be configured to be short, whereby a double-sided image can be formed speedily.

The paper-transport path 16 for formation of an image on a single side comprises only rollers R1 through R7 disposed in the apparatus main body, and rollers R8 and R9 disposed in the door cover 13, the covering member 14 can be mounted to the door cover 13 in place of the double-sided printing unit 70, and the covering member 14 has no rollers for transporting paper. Accordingly, when user has selected and mounted the double-sided printing unit 70, only the covering member 14 goes to waste. Further, since no roller is provided on the covering member 14, the waste can be minimized.

The image forming apparatus is such an image forming apparatus in which the manual paper feeding unit 80 is disposed on the side face of the apparatus main body 10, and the double-sided printing unit 70 is detachable from the apparatus main body 10 in a state where the manual paper feeding unit 80 remains disposed on the apparatus main body 10. Accordingly, when the user has selected and mounted the double-sided printing unit 70, the manual paper feeding unit 80 is also prevented from going to waste.

The image forming apparatus has such a configuration that the manual paper feeding unit 80 is formed at the apparatus main body 10 and the door cover 13 which is openably disposed on the side face of the apparatus main body, and that the double-sided printing unit 70 can be detachably mounted to upper portion of the manual paper feeding unit 80 of the door cover 13. Accordingly, the double-sided printing unit 70 is mounted to the door cover 13 which originally forms the side face of the apparatus main body 10.

Therefore, the transporting unit dedicated for forming a single-sided image, which would have hitherto go to waste, as well as the door cover itself are prevented from being of no use. Furthermore, the manual paper feeding unit 80 does not go to waste, as well.

Heretofore, the embodiment and the example of the invention have been described, however, the invention is not limited thereto, and can be modified in various ways within the scope of the invention as set forth in the appended claims.

Hereinafter, a second embodiment of an image forming apparatus according to the present invention will be described by reference to FIGS. 11 to 23.

Figure 11:
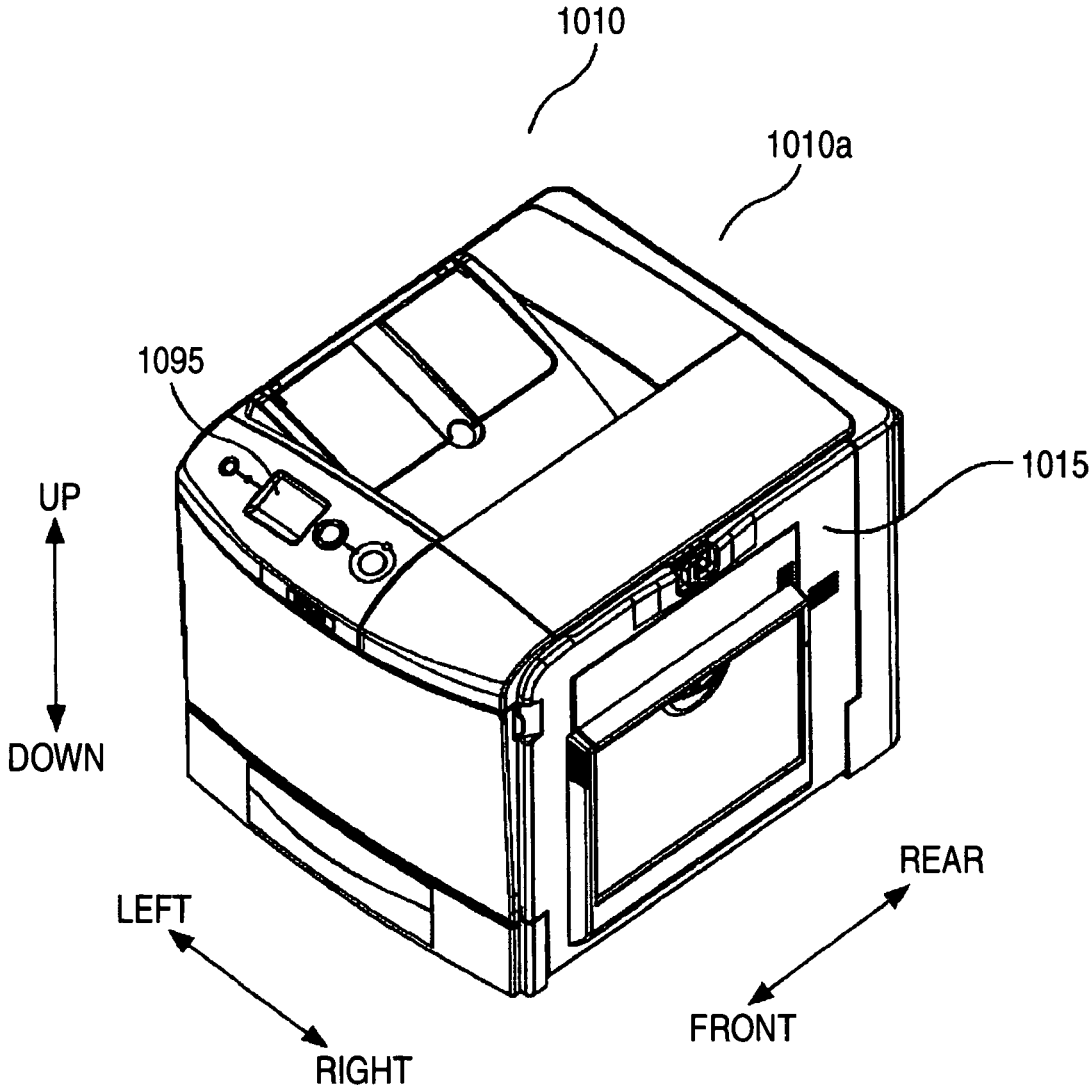
FIG. 11 is a perspective view illustrating a printer 1010 according to an embodiment of the present invention.
Figure 12:
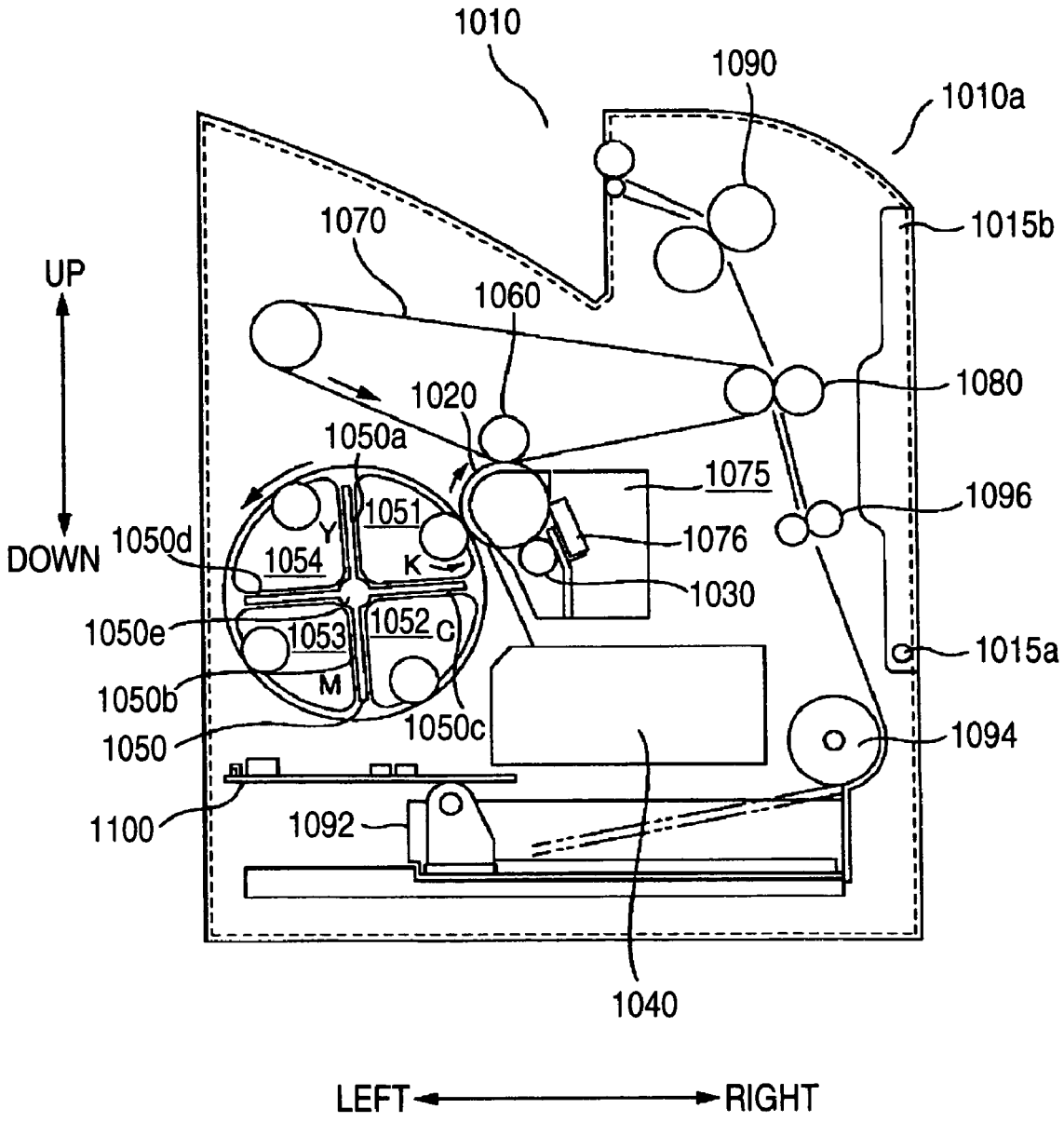
FIG. 12 is a view illustrating primary constituent elements of the printer 1010.

Reference to FIGS. 11 and 12 will describe general features of an image forming apparatus described while adopting a laser beam printer (printer) 10 as an example. Meanwhile, in FIGS. 11 and 12, arrows indicate perpendicular directions, for instance, a paper transport tray 1092 is disposed in the lower portion of the printer 1010, and a fixing unit 1090 is disposed in the upper portion of the printer 1010.

As shown in FIG. 12, the printer 1010 according to an embodiment has, along a rotational direction of a photosensitive member 1020, an electrification unit 1030, an exposure unit 1040, a development device retaining unit 1050, a primary transfer unit 1060, an intermediate transfer unit 1070, and a cleaning unit 1075. The printer 1010 further has a secondary transfer unit 1080, the fixing unit 1090, a side-face cover 1015 serving as an example of a openable cover, a display unit 1095 and which is formed from a liquid crystal panel, and a control unit 1100 which controls these units, and the like, thereby governing operations for serving as a printer.

The photosensitive member 1020 has a cylindrical, conductive substrate, and a photosensitive layer formed on the peripheral surface thereof. The photosensitive member 1020 can rotate about a center axis, in the present embodiment, can rotate clockwise as indicated by an arrow in FIG. 12.

The electrification unit 1030 is a unit for electrifying the photosensitive member 1020. The exposure unit 1040 is a unit for radiating a laser beam, thereby forming a latent image on the electrified photosensitive member 2100. The exposure unit 1040 has a semiconductor laser, a polygon mirror, an F-θ lens, and the like. The exposure unit 1040 radiates, on the electrified photosensitive member 1020, a laser beam having been modulated in accordance with an image signal input from a host computer (not shown), such as a personal computer, or a word processor.

The development device retaining unit 1050 is a device for developing a latent image formed on the photosensitive member 1020 with use of toner, serving as an example of toner stored in a development device, more specifically, black (K) toner stored in a black development device 1051, magenta (M) toner stored in a magenta development device 1053, cyan (C) toner stored in a cyan development device 1052, and yellow (Y) toner stored in a yellow development device 1054.

The development device retaining unit 1050 rotates in a state where the four development devices 1051 through 1054 are attached thereon, thereby being capable of moving positions of the four development devices 1051, 1052, 1053, and 1054. More specifically, the development device retaining unit 1050 retains the four development devices 1051 to 1054 by means of four attachment/detachment sections 1050*a*, 1050*b*, 1050*c*, and 1050*d*. Accordingly, the four development devices 1051 to 1054 can rotate about a rotational shaft 1050*e* while maintaining relative positions among them. Every time image formation of one page is completed, the development device retaining unit 1050 selectively opposes the photosensitive member 1020, thereby developing the latent image formed on the photosensitive member 1020 sequentially with toner stored in the respective development devices 1051 to 1054. Meanwhile, the respective four development devices 1051 to 1054 are detachable in relation to the attachment/detachment sections of the development device retaining unit 1050.

The primary transfer unit 1060 is a unit for transferring onto the intermediate transfer member 1070 monochrome toner images formed on the photosensitive member 1020. The toner of four colors is sequentially transferred in a superimposing manner, whereby a full-color toner image is formed on the intermediate transfer member 1070. The intermediate transfer member 1070 is an endless belt formed by means of depositing an aluminum deposition layer on the surface of a PET film, and further forming and laminating a semi-conductive coating layer on the surface thereof. The intermediate transfer member 1070 is rotationally driven at substantially the same circumferential velocity as that of the photosensitive member 1020. The secondary transfer unit 1080 is a unit for transferring onto a medium, such as paper, a film, or cloth, a monochrome toner image or a full-color toner image formed on the intermediate transfer member 1070.

The fixing unit 1090 is a device for fixing the monochrome toner image or the full-color toner image having been transferred onto the medium, thereby rendering a permanent image. Meanwhile, a detailed configuration of the fixing unit 1090 will be described later.

The cleaning unit 1075 is disposed between the primary transfer unit 1060 and the electrification unit 1030, and has a rubber cleaning blade 1076 which is in contact with the surface of the photosensitive member 1020. The cleaning unit 1075 is a device for, after a toner image has been transferred onto the intermediate transfer member 1070 by means of the primary transfer unit 1060, scraping residual toner on the photosensitive member 1020 with use of the cleaning blade 1076, to thus remove the same.

As shown in FIG. 11, the side-face cover 1015 is disposed on the right side face of a printer main body 1010*a*. As shown in FIG. 12, the side-face cover 1015 has, at a vertically-lower portion thereof, a coupling shaft 1015*a*, serving as an example of a coupling section, supported on the printer main body 1010*a*; and opens/closes about the coupling shaft 1015*a* serving as a pivot. The printer 1010 can form an image in a state where the side-face cover 1015 is closed. Meanwhile, in a state where the side-face cover 1015 is open, a user, or the like, can remove a medium jammed inside the printer 1010 (a medium jammed in the vicinity of the fixing unit 1090). The side-face cover 1015 has, at a vertically-upper portion thereof, a tab 1015*b*. A user, or the like, opens/closes the side-face cover 1015 by grasping the tab 1015*b*.

As shown in FIG. 12, one registration roller of a pair of registration rollers 1096 is supported on the side-face cover 1015. In addition, a motor (not shown) for rotating the one of the registration rollers, and a guide plate serving as a guide during the course for feeding a medium are disposed on the side-face cover 1015. Meanwhile, the registration rollers 1096, the motor, and the guide plate serve as an example set of a "medium-transport mechanism."

The side-face cover 1015 of the above configuration can be joined to the fixing unit 1090 by way of a first arm 1610 and a second arm 1620. The first arm 1610 and the second arm will be described in detail later.

Figure 13:
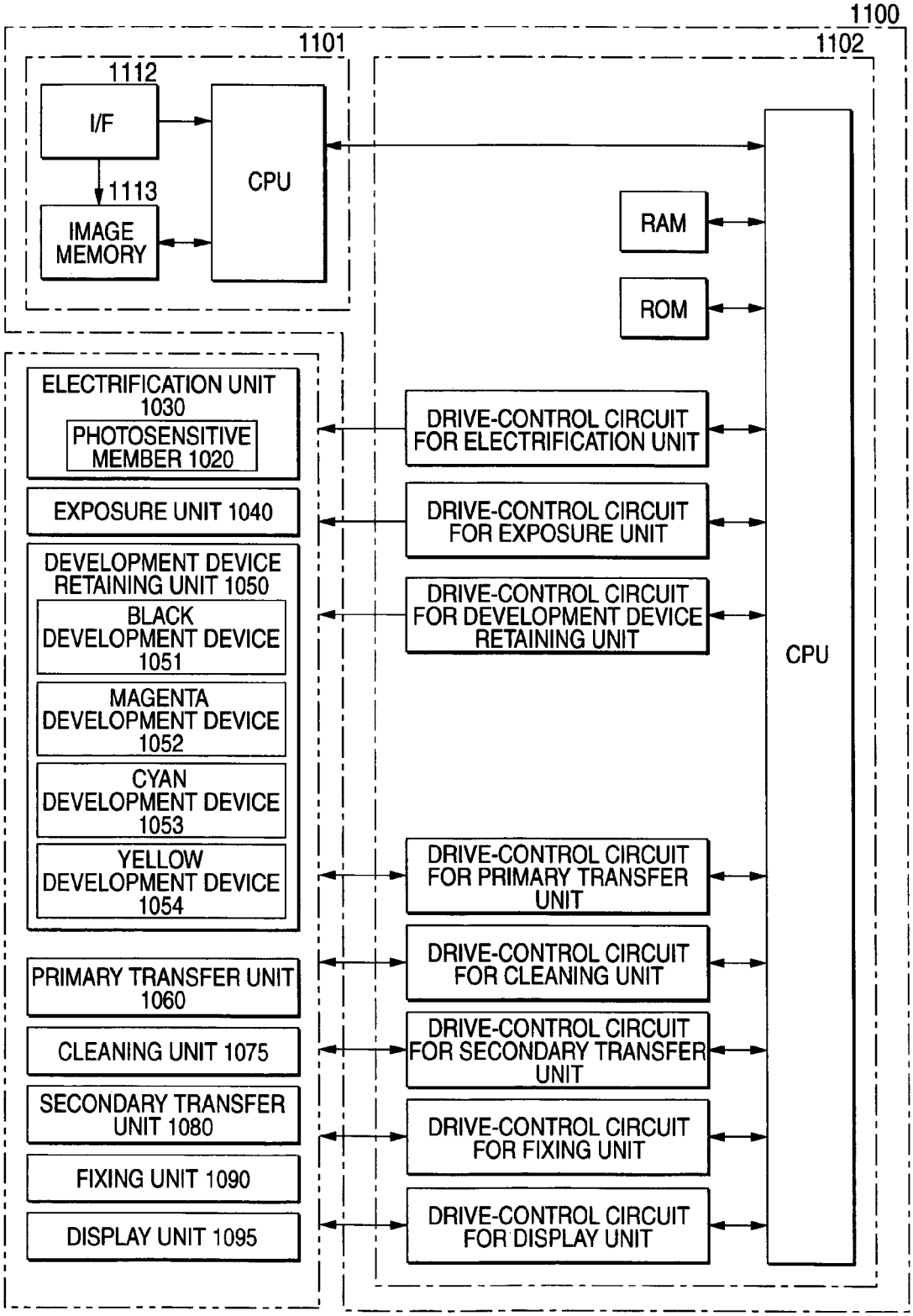
FIG. 13 is a block diagram illustrating a control unit 1100 of the printer 1010.

As shown in FIG. 13, the control unit 1100 comprises a controller section 1101 and a unit-control section 1102. An image signal and a control signal are input to the controller section 1101. The unit-control section 1102 controls the respective units, and the like, in accordance with an instruction on the basis of the image signal and the control signal, thereby forming an image.

Next, operations of the printer 1010 configured as above will be described.

First, when an image signal and a control signal output from a host computer (not shown) are input to the controller section 1101 of the printer 1010 by way of an interface (I/F) 1112, the photosensitive member 1020, the developing roller, and the intermediate transfer member 1070 rotate under the control of the unit control section 1102 on the basis of an instruction issued from the controller section 1101. While being rotated, the photosensitive member 1020 is sequentially electrified by the electrification unit 1030 at an electrifying position.

The thus-electrified region on the photosensitive member 1020 reaches an exposure position in the course of rotation of the photosensitive member 1020, and a latent image is formed on the region in accordance with image data of a first color, e.g., yellow (Y). Meanwhile, the development device retaining unit 1050 is in a state where the yellow development device 1054, in which the yellow (Y) toner is stored, is at a developing position opposing the photosensitive member 1020. The latent image formed on the photosensitive member 1020 reaches the developing position in the course of rotation of the photosensitive member 1020, where development of the image with the yellow toner by the yellow development device 1054 is performed. As a result, a yellow toner image is formed on the photosensitive member 1020.

The yellow toner image formed on the photosensitive member 1020 reaches a primary transfer position in the course of rotation of the photosensitive member 1020, where the image is transferred onto the intermediate transfer member 1070 by the primary transfer unit 1060. At this time, a primary transfer voltage of the polarity opposite the electrified polarity of the toner is applied onto the primary transfer unit 1060. Meanwhile, during the above processing, the photosensitive member 1020 and the intermediate transfer member 1070 are in contact with each other, and the secondary transfer unit 1080 is separated from the intermediate transfer member 1070.

The above processing is sequentially effected for each of the development devices of a second color, a third color, and a fourth color, whereby toner images of the four colors corresponding to the respective image signals are transferred onto the intermediate transfer member 1070 in a superimposed manner. As a result, a full-color toner image is formed on the intermediate transfer member 1070.

The full-color toner image formed on the intermediate transfer member 1070 reaches a secondary transfer position in the course of rotation of the intermediate transfer member 1070, where the image is transferred onto a medium by the secondary transfer unit 1080. Meanwhile, the medium is transported from the paper transport tray to the secondary transfer unit 1080 by way of a paper transporting roller 1094 and the registration rollers 1096. Meanwhile, during the course of the transfer operation, the secondary transfer unit 1080 is pressed against the intermediate transfer member 1070, and a secondary transfer voltage is applied onto the secondary transfer unit 1080.

The full-color toner image having been transferred onto the medium is heated and pressed by the fixing unit 1090, thereby being fixed on the medium. Meanwhile, after having passed the primary transfer position, toner affixed on the surface of the photosensitive member 1020 is scraped by the cleaning blade 1076 supported on the cleaning unit 1075, whereby the photosensitive member 1020 prepares for formation of the next latent image. The thus-scraped toner is recovered in a residual-toner-collecting section provided in the cleaning unit 1075.

Next, the configuration of the control unit 1100 will be described by reference to FIG. 13. FIG. 13 is a block diagram illustrating the control unit 1100. The controller section 1101 of the controller unit 1100, which is connected to the host computer by way of the interface 1112, has an image memory 1113 for storing image signals input from the host computer. The unit-control section 1102 is electrically connected to the respective units (the electrification unit 1030, the exposure unit 1040, the development device retaining unit 1050, the primary transfer unit 1060, the cleaning unit 1075, the secondary transfer unit 1080, the fixing unit 1090, and the display unit 1095) of an apparatus main body. The unit-control section 1102 receives signals output from sensors provided in the respective units, thereby controlling the respective units on the basis of signals input from the controller section 1101 while detecting statuses of the respective units.

Figure 14:
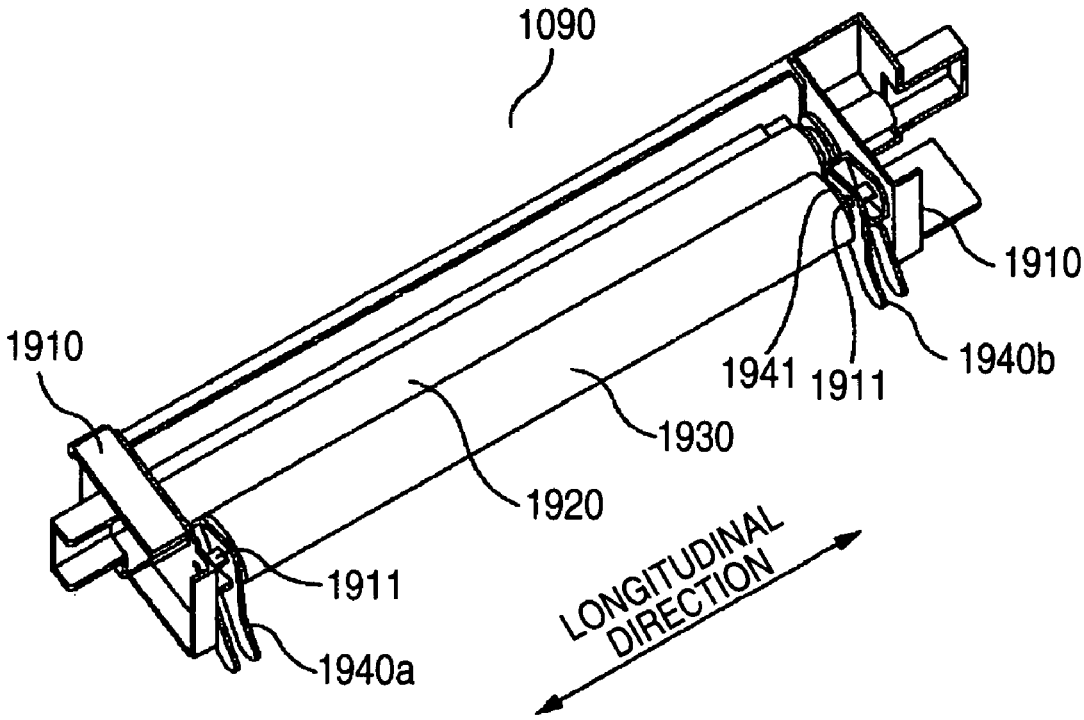
FIG. 14 is a perspective view illustrating a fixing unit 1090 of the printer 1010.

Next, the fixing unit 1090 for fixing a toner image on a medium will be described by reference to FIGS. 14, 15A, and 15B. Meanwhile, the fixing unit 1090 fixes a toner image on a medium in the state where the pressing roller is pressed against the fixing roller 1920. In contrast, the pressing roller 1930 is separated from the fixing roller 1920 so that a user, or the like, can remove a medium which is jammed in a state of being nipped between the fixing roller 1920 and the pressing roller 1930.

The fixing unit 1090 has a frame 1910, the fixing roller 1920, the pressing roller 1930, pressing levers 1940*a* and 1940*b*; and a tension spring 1960.

The fixing roller 1920 heats, in a state where the surface thereof is heated, a toner image having been transferred onto a medium, thereby fixing the image onto the medium. The fixing roller 1920 has a heater inside for heating the surface of the fixing roller 1920. In addition, as shown in FIG. 14, the fixing roller 1920 is rotatably supported in the frame 1910 on two longitudinal ends by way of bearings.

The pressing roller 1930 presses the toner image having been transferred onto the medium in the state of being pressed against the fixing roller 1920. In addition, in the state of being pressed against the fixing roller 1920, the pressing roller 1930 holds the medium on which the toner image has been transferred, between the pressing roller 1930 and the fixing roller 1920. Meanwhile, as shown in FIG. 15A, in a case where the fixing roller 1920 and the pressing roller 1930 hold no medium therebetween, the pressing roller 1930 is pressed into contact with the fixing roller 1920. The pressing roller 1930 is also rotatably supported in the frame 1910 on two longitudinal ends by way of bearings. When the fixing roller 1920 and the pressing roller 1930 rotate in a state of holding the medium therebetween, the medium is transported while the transferred toner image is fixed onto the medium.

Each of the pressing levers 1940*a*, 1940*b* has a grip section 1941. The grip section 1941 rotatably grips the pressing roller 1930. In addition, the pressing lever 1940*a* is disposed on one longitudinal end, and the pressing lever 1940*b* is disposed on the other end. Each of the pressing levers 1940*a*, 1940*b* is pivotably supported on a frame shaft 1911 (FIG. 4) disposed on the frame 1910. More specifically, the pressing lever 1940*a*, 1940*b* can pivot about the frame shaft 1911 in relation to the frame 1910.

The tension spring 1960 is supported on a spring latch 1912 on the frame 1910 at one end, and on a spring latch 1942 on the pressing lever 1940*a*, 1940*b* at the other end. The tension spring 1960 exerts a tensile force so as to pull the spring latch 1942 of the pressing lever 1940*a*, 1940*b* toward the spring latch 1912 on the frame 1910. The pressing lever 1940*a*, 1940*b* gripping the pressing roller 1930 is pivoted by the tensile force of the tension spring 1960, on the frame shaft 1911 serving as a pivot. When, e.g., as shown in FIG. 15A, the pressing lever 1940*a*, 1940*b* gripping the pressing roller 1930 is pivoted clockwise in FIG. 15A (i.e., when the pressing roller 1930 is pressed against the fixing roller 1920), the pressing roller 1930 is pressed into contact with the fixing roller 1920. Thus, the tension spring 1960 presses the pressing roller 1930 against the fixing roller 1920.

Figure 15A:
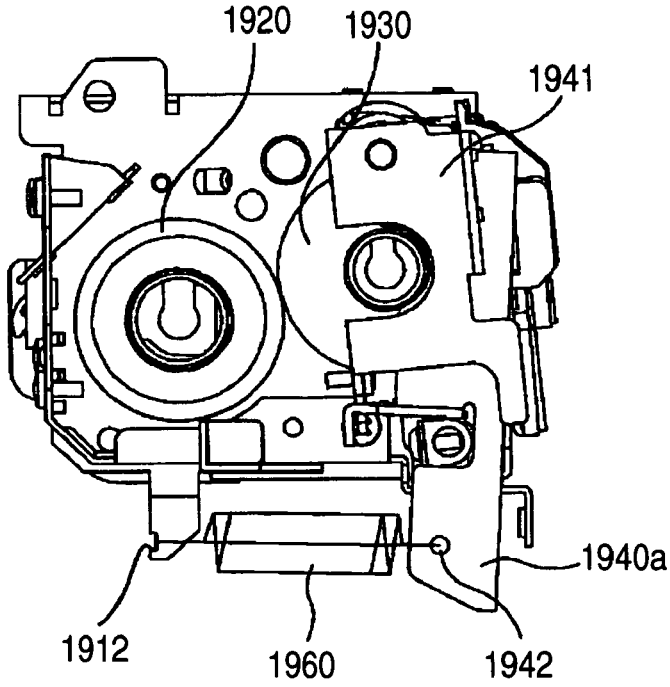
FIG. 15A is a view illustrating the fixing unit 1090 in a state where a pressing roller 1930 is pressed against a fixing roller 1920.
Figure 15B:
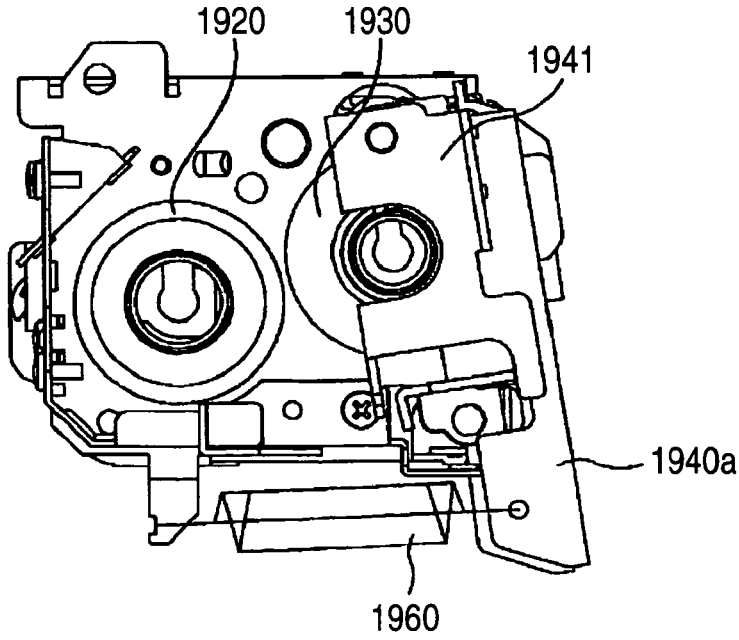
FIG. 15B is a view illustrating the fixing unit 1090 in a state where the pressing roller 1930 is separated from the fixing roller 1920.

Meanwhile, when the pressing lever 1940*a*, 1940*b* gripping the pressing roller 1930 are pivoted counterclockwise in FIG. 15A (i.e., when the pressure exerted on the pressing roller 1930 by the tension spring 1960 is released) by pressure-releasing sections (described later) of the first arm 1610 and the second arm 1620, the pressing roller 1930 is separated from the fixing roller 1920 as shown in FIG. 15B.

The fixing unit 1090 of the above configuration fixes the toner image on the medium, which is nipped between the fixing roller 1920 and the pressing roller 1930 on which pressure is exerted by the tension spring 1960 in a state where the side-face cover 15 is closed.

Next, the connecting member will be described. The connecting member is connected to the side-face cover 1015 and the fixing unit 1090, and operates in association with an opening/closing motion of the side-face cover 1015. The connecting member presses the pressing roller 1930 against the fixing roller 1920 at the time the side-face cover 1015 is closed, and separates the pressing roller 1930 from the fixing roller 1920 at the time the side-face cover 1015 is opened. In the present embodiment, the printer 1010 has, as the connecting member, the first arm 1610 and the second arm 1620. The first arm 1610 is disposed in the front right portion (see FIG. 11) of the printer 1010, and the second arm 1620 is disposed in the rear right portion (see FIG. 11) of the printer 1010. Meanwhile, the first arm 1610 and the second arm 1620 differ in configuration and operations. Accordingly, hereinbelow, the configuration and operations of the first arm 1610 and those of the second arm 1620 will be described.

Figure 16:
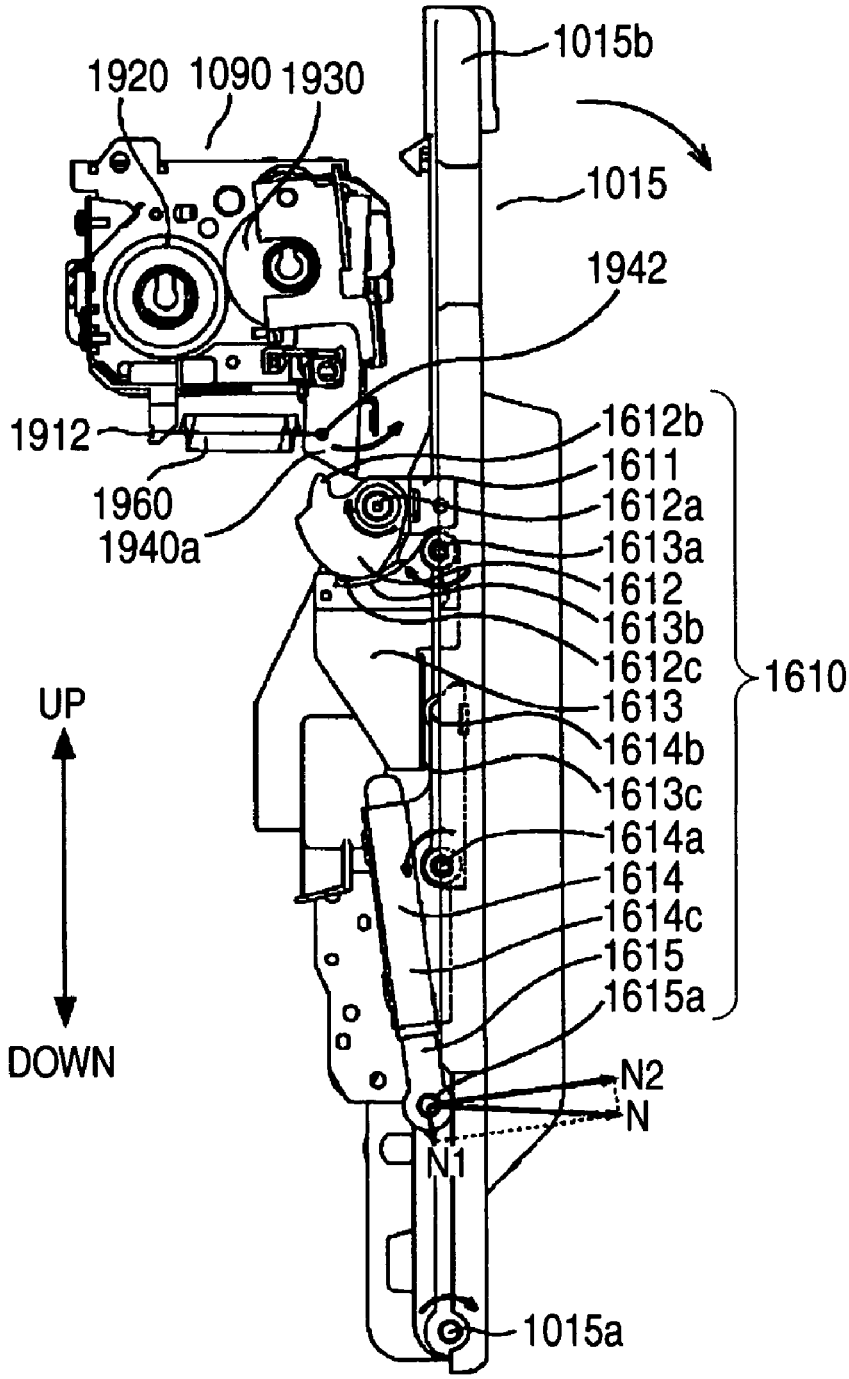
FIG. 16 is a view illustrating a first arm 1610, and the like, with a side-face cover 1015 closed.
Figure 17:
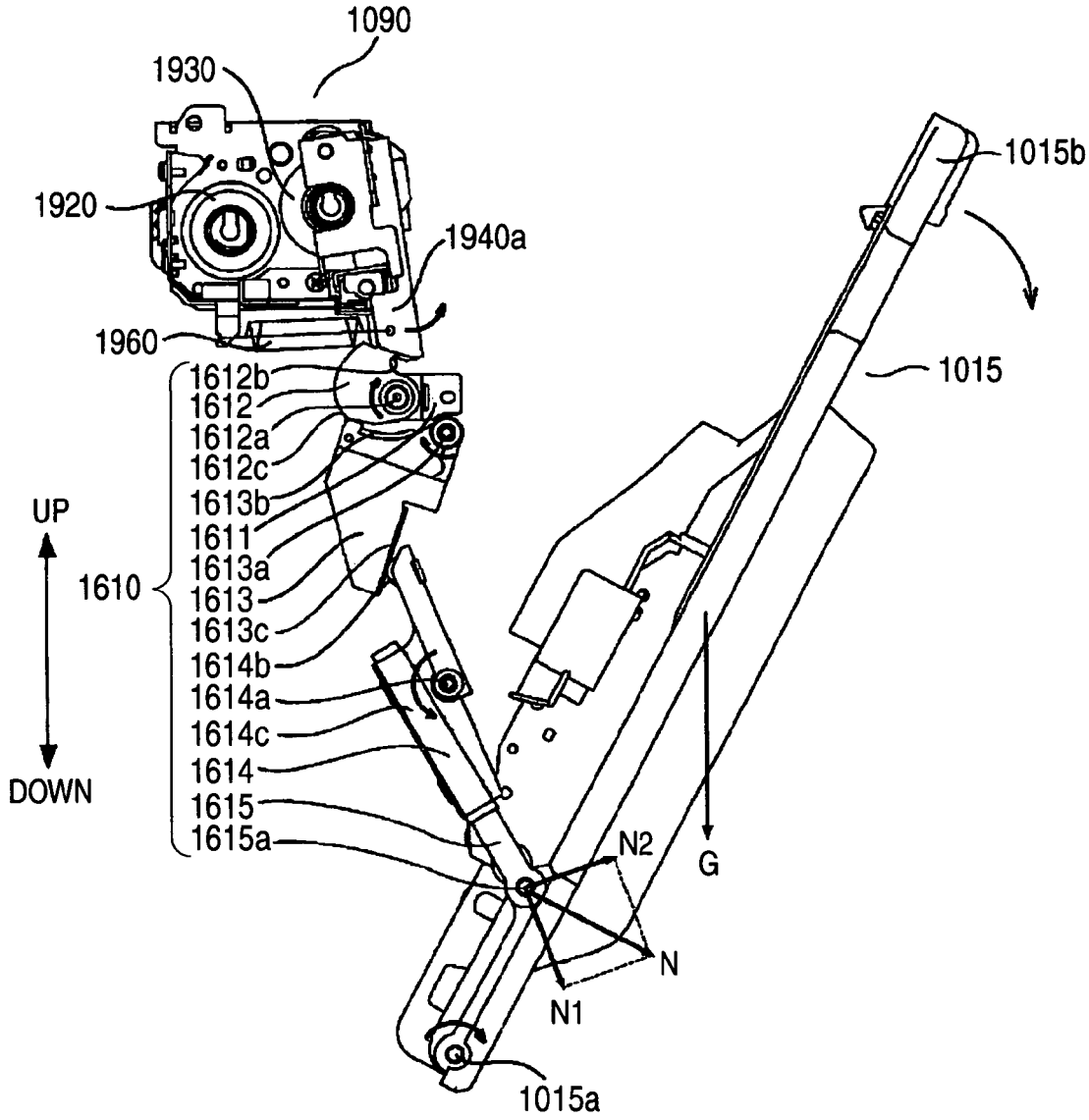
FIG. 17 is a view illustrating the first arm 1610, and the like, with the pressure exerted by a tension spring 1960 being released.
Figure 18:
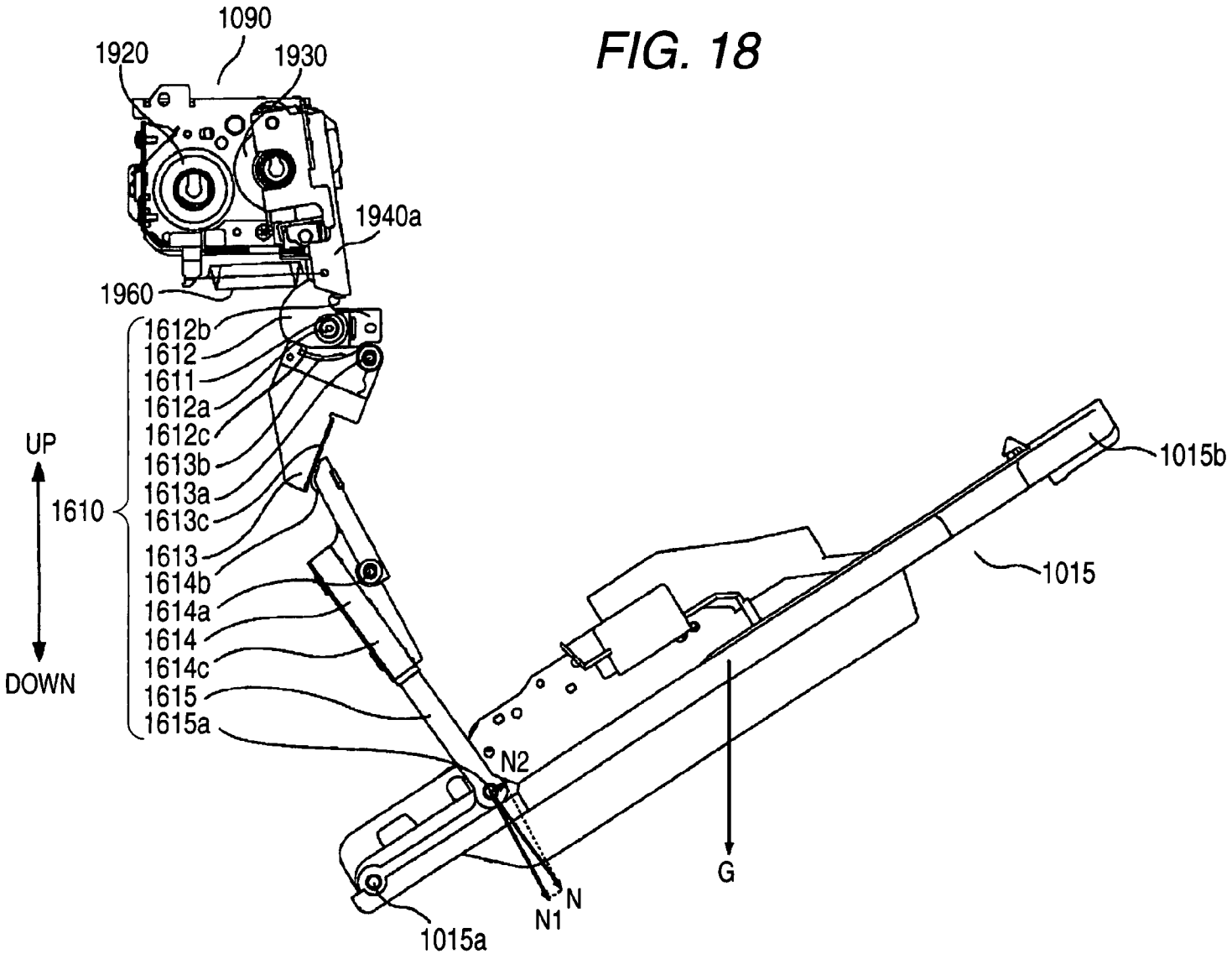
FIG. 18 is a view illustrating the first arm 1610, and the like, with the side-face cover 1015 fully open.

The configuration of the first arm 1610 will be described by reference to FIGS. 16 to 18. Meanwhile, FIGS. 16 to 18 are diagrams as viewed from the front of the printer 1010 (see FIG. 11).

The first arm 1610 transmits to the pressing lever 1940*a* of the fixing unit 1090 a force that acts on the side-face cover 1015. The first arm 1610 has a fixed member 1611 fixed on a frame (not shown) of the printer main body 1010*a*, a first lever abutting member 1612, a lever-side member 1613, a cover-side member 1614, and a first sliding member 1615.

The first lever abutting member 1612 is supported pivotably about a shaft A 1612*a*, in relation to the fixed member 1611 fixed on the frame (not shown) of the printer main body 1010*a*. A first lever abutting section 1612*b*, which can be brought into contact with the pressure lever 1940*a*, is disposed at one end of the first lever abutting member 1612. In addition, a cam 1612*c* is formed at the other end of the first lever abutting member 1612.

The lever-side member 1613 is pivotably supported on a shaft B 1613*a* fixed on the frame (not shown) of the printer main body 1010*a*. A cam abutting section 1613*b*, which is to be brought into contact with the cam 1612*c*, is disposed at the other end of the lever-side member 1613. A cam abutting section 1613*c* formed from a flat face is disposed at the other end of the lever-side member 1613.

The door cover-side member 1614 is pivotably supported on a shaft C 1614*a* fixed on the frame (not shown) of the printer main body 1010*a*. A cam 1614*b* formed from a roller is disposed at one end of the door cover-side member 1614. The cam 1614*b* is in contact with the cam abutting section 1613*b* of the lever-side member 1613. In addition, a first slideway section 1614*c* is disposed at the other end of the door cover-side member 1614.

The first sliding member 1615 slides on the first slideway section 1614*c*. The first sliding member 1615 is restricted in its motion by the first slideway section 1614*c* so as to slide only in a predetermined direction (hereinafter called a "sliding direction") in relation to the first slideway section 1614*c*. Therefore, upon receipt of an external force parallel to the sliding direction, the first sliding member 1615 slides on the first slideway section 1614*c*. Meanwhile, upon receipt of an external force orthogonal to the sliding direction, the first sliding member 1615 does not slide in relation to the first slideway section 1614*c*, and transmits the external force to the first slideway section 1614*c*. In addition, the first sliding member 1615 is pivotably connected to a shaft D 1615*a* supported on the side-face cover 1015. Meanwhile, each of the first sliding member 1615 and the first slideway section 1614*c* is made of a metal.

Of the first arm 1610 is formed by means of connecting a plurality of linkages, more specifically, the first lever abutting member 1612, the lever-side member 1613, and the door cover-side member 1614. In addition, as described above, each of the linkages, more specifically, each of the first lever abutting member 1612, the lever-side member 1613, and the door cover-side member 1614 can pivot when the side-face cover 1015 opens/closes. Meanwhile, since each of the shafts A 1612*a*, B 1613*a*, and C 1614*a* is fixed onto the printer main body 1010*a*, the shafts do not move when the side-face cover 1015 opens/closes. In contrast, the shaft D 1615*a*, which is supported on the side-face cover 1015, moves along with opening/closing of the side-face cover 1015.

When a user, or the like, opens the side-face cover 1015 to remove a medium jammed in the printer 1010, first, the first arm 1610 releases the pressure exerted on the pressing roller 1930 by the tension spring 1960 in association with the opening motion of the side-face cover 1015. After the pressure exerted on the pressing roller 1930 by the tension spring 1960 has been released, the first sliding member 1615 slides the first slideway section 1614*c* in association with the opening motion of the side-face cover 1015. Hereinbelow, operations the first arm 1610 at the time when the side-face cover 1015 is opened will be described by reference to FIGS. 16 to 18.

As shown in FIG. 16, in the state where the side-face cover 1015 is closed, the first arm 1610 (i.e., the first lever abutting member 1612, the lever-side member 1613, the door cover-side member 1614, and the first sliding member 1615) is folded so as to be compact in size. Under such a condition, the first lever abutting section 1612*b* of the first lever abutting member 1612 is not in contact with the pressing lever 1940*a* (even when the abutting occurs, only to a slight extent). Therefore, the spring latch 1940 of the pressing lever 1940*a* gripping the pressing roller 1930 is pulled by the tension spring 1960 toward the spring latch 1912 on the frame 1910. Thus, as shown in FIG. 16, the pressing roller 1930 is pressed into contact against the fixing roller 1920 by the tensile force of the tension spring 1960.

When a user, or the like, standing by the right side face (see FIG. 11) of the printer 1010 pulls the tab 1015*b* of the closed side-face cover 1015, the side-face cover 1015 pivots about the coupling shaft 1015*a*. Along with clockwise rotation (in a direction indicated by the arrow in FIG. 16) of the side-face cover 1015, the shaft D 1615*a* supported on the side-face cover 1015 pivots about the coupling shaft 1015*a*.

A direction along which the shaft D 1615*a* moves is a direction orthogonal to a virtual line connecting the coupling shaft 1015*a* and the shaft D 1615*a*, which is a direction indicated by an arrow N in FIG. 16. More specifically, when the side-face cover 1015 starts to open from a closed state, the first sliding member 1615 receives an external force N indicated in FIG. 16 from the side-face cover 1015, by way of the shaft D 1615*a*.

Here, as shown in FIG. 16, of the external force N, a force component parallel to the sliding direction is designated N1, and another force component orthogonal to the sliding direction is designated N2. The force N1 corresponds to a force in a direction for causing the first sliding member 1615 to slide on the first-slideway section 1614*c*. In contrast, the force N2 is a force in a direction along which the first-slideway section 1614*c* restricts the motion of the first sliding member 1615. Accordingly, the force N2 corresponds to a force in a direction along which the first sliding member 1615 can transmit the force to the first-slideway section 1614*c*.

As shown in FIG. 16, the respective constituent elements (i.e., the coupling shaft 1015*a*, the shaft D 1615*a*, the first sliding member 1615, and the first slideway section 1614*c*) are arranged so that, in a state where the side-face cover 1015 is closed, the virtual line connecting the coupling shaft 1015*a* and the shaft D 1615*a* becomes substantially parallel to the sliding direction. Consequently, the direction in which the external force N acts on the first sliding member 1615 is a direction substantially orthogonal to the sliding direction. Accordingly, the greater portion of the external force N is the force N2, and the force N1 is significantly small as compared with the force N2. More specifically, upon receipt of an external force N in a state where the side-face cover 1015 starts to open, the first sliding member 1615 hardly slides on the first slideway section 1614*c*, and transmits the external force to the first slideway section 1614*c*.

The door cover-side member 1614 having the first slideway section 1614*c* is pivotably supported on the shaft C 1614*a*. As a result, when the first slideway section 1614*c* receives the force N2 from the first sliding member 1615, the force acts as a force for pivoting the door cover-side member 1614 counterclockwise in FIG. 16 about the shaft C 1614*a*. When the door cover-side member 1614 receives the counterclockwise-pivotal force, this force is transmitted to the lever-side member 1613 by way of the cam 1614*b*.

The lever-side member 1613 receives the force from the cam 1614*b* of the door cover-side member 1614 with the cam abutting section 1613*c* formed from a flat face. As a result, the lever-side member 1613 receives from the door cover-side cover 1614 a force orthogonal to the flat face of the cam abutting section 1613*c*. Meanwhile, the lever-side member 1613 is pivotably supported on the shaft B 1613*a*. Accordingly, the force that the lever-side member 1613 has received from the door cover-side member 1614 acts as a force for pivoting the lever-side member 1613 clockwise in FIG. 16 about the shaft B 1613*a*. When the lever-side member 1613 receives the clockwise-pivotal force, this force is transmitted to the first lever abutting member 1612 by way of the cam 1612*c*.

The first lever abutting member 1612 is pivotably supported on the shaft A 1612*a*. Accordingly, upon receipt of the force from the lever-side member 1613, the first lever abutting member 1612 pivots clockwise in FIG. 16.

As can be comprehended from the above descriptions, when a user opens the closed side-face cover 1015, in association with the motion of the side-face cover 1015, the door cover-side member 1614 piovots counterclockwise in FIG. 16, and the first lever abutting member 1612 piovots clockwise. Subsequently, immediately after the side-face cover 1015 starts to open, the first lever abutting section 1612*b* of the first lever abutting member 1612 comes into contact with the pressing lever 1940*a*.

The pressing lever 1940*a* receives a clockwise-pivotal force, which is a direction opposite that indicated by the arrow in FIG. 16, by a tensile force of the tension spring 1960. This force acts as a force for pivoting the door cover-side member 1614 clockwise, which is a direction opposite that indicated by the arrow in FIG. 16, by way of the first lever abutting member 1612 and the lever-side member 1613. The force for pivoting the door cover-side member 1614 clockwise is transmitted to the shaft D 1615*a* supported on the side-face cover 1015 by way of the first sliding member 1615.

The force received by the side-face cover 1015 by way of the first sliding member 1615 is a force in a direction orthogonal to the sliding direction of the first sliding member 1615. Meanwhile, when the side-face cover 1015 starts to open, the virtual line connecting the coupling shaft 1015*a* and the shaft D 1615*a* is substantially parallel to the sliding direction. Therefore, the force received by the side-face cover 1015 by way of the first sliding member 1615 is a force for pivoting the side-face cover 1015 about the coupling shaft 1015*a*.

More specifically, after first lever abutting section 1612*b* has come into contact with the pressing lever 1940*a*, the tensile force of the tension spring 1960 is transmitted to the side-face cover 1015. Meanwhile, when the side-face cover 1015 starts to open, the tensile force of the tension spring 1960 acts on the side-face cover 1015 as a force in a direction that closes the side-face cover 1015.

Accordingly, when the user further opens the side-face cover 1015 after the first lever abutting section 1612*b* has come into contact with the pressing lever 1940*a*, the user receives, against the direction that opens the side-face cover 1015, a resistance exerted by the tensile force of the tension spring 1960. In addition, an own weight G of the side face cover 1015 acts in the direction that opens the side-face cover 1015. However, in a state where the side-face cover 1015 is open narrow, an action force exerted by the own weight G of the side-face cover 1015 is small. Accordingly, even when the user releases his/her hand from the side-face cover 1015 at this time, the side-face cover 1015 does not burst open.

When the side-face cover 1015 is opened further against the tensile force of the tension spring 1960, the force with which the first lever abutting section 1612*b* presses the pressing lever 1940*a* exceeds the tensile force of the tension spring 1960, whereby the pressing lever 1940*a* pivots counterclockwise (the direction indicated by the arrow in FIG. 16) about the frame shaft 1911. When the pressing lever 1940*a* gripping the pressing roller 1930 has pivoted to assume a state indicated in FIG. 17, the pressing roller 1930 is separated from the fixing roller 1920. More specifically, the pressure exerted on the pressing roller 1930 by the tension spring 1960 is released.

Meanwhile, in the duration between the time when the first lever abutting section 1612*a* has made contact with the pressing lever 1940*a* and the time when the pressure exerted on the pressing roller 1930 by the tension spring 1960 is released, the first sliding member 1615 hardly slides on the first slideway section 1614*c*. Therefore, upon opening of the side-face cover 1015, the user receives the resistance exerted by the tensile force of the tension spring 1960, however, the user is saved from receiving a resistance produced by sliding of the first sliding member 615.

Meanwhile, when the side-face cover 1015 starts to open, the virtual line connecting the coupling shaft 1015*a* and the shaft D 1615*a* is substantially parallel to the sliding direction. However, when the side-face cover 1015 is opened, in association with the motion of the side-face cover 1015, the door cover-side member 1614 pivots, thereby changing a relative position between the door cover-side member 1614 and the coupling shaft 1015*a*. As a result, when the pressure exerted on the pressing roller 1930 by the tension spring 1960 has been released, as shown in FIG. 17, the sliding direction is no longer parallel to the virtual line connecting the coupling shaft 1015*a* and the shaft D 1615*a*.

As shown in FIG. 17, in a state where the sliding direction intersects with the virtual line connecting the coupling shaft

1015*a* and the shaft D 1615*a* at a large angle, in contrast to the state shown in FIG. 16, the force that pivots the door cover-side member 1614 clockwise is hardly exerted on the side-face cover 1015 as the force in the direction that closes the side-face cover 1015. The reason therefor is that the force received by the side-face cover 1015 by way of the first sliding member 1615 is a force in the direction orthogonal to the sliding direction of the first sliding member 1615, and of the force, the component in the direction parallel to the virtual line connecting the coupling shaft 1015*a* and the shaft D 1615*a* does not act on the side-face cover 1015 as the force in the direction that closes the side-face cover 1015. Accordingly, after the pressure exerted on the pressing roller 1930 by the tension spring 1960 has been released, the tensile force of the tension spring 1960 is hardly exerted as the force in the direction that closes the side-face cover 1015.

Meanwhile, when the pressure exerted on the pressing roller by the tension spring 1960 has been released, since the side-face cover 1015 is open wider as compared with the time when the side-face cover 1015 starts to open, the own weight G of the side-face cover 1015 acts strongly in the direction that opens the side-face cover 1015. The effect by the own weight G of the side-face cover 1015 increases as the side-face cover 1015 opens wider.

Therefore, after the pressure exerted on the pressing roller by the tension spring 1960 has been released, there arises a necessity for any resistance which acts against the opening motion of the side-face cover 1015 in place of the tensile force of the tension spring 1960. In the present embodiment, a frictional force produced by sliding of the first sliding member 1615 in relation to the first slideway section 1614*c* serves as the resistance against the opening motion of the side-face cover 1015.

When the pressure exerted on the pressing roller by the tension spring 1960 has been released, the first sliding member 1615 receives the external force N indicated in FIG. 17 from the side-face cover 1015 by way of the shaft D 1615*a*. In relation to this, as shown in FIG. 17, of the external force N, a force component parallel to the sliding direction is set to N1, and another force component orthogonal to the sliding direction is set to N2.

After the pressure exerted on the pressing roller 1930 by the tension spring 1960 has been released, as compared with the time when the side-face cover 1015 starts to open (see FIG. 16), the force component N1 parallel to the sliding direction is increased and the force component N2 orthogonal to the sliding direction is decreased (see FIG. 17). This indicates that, in a state where the side-face cover 1015 is open, the force in the direction that opens the side-face cover 1015 acts as a force for causing the first sliding member 1615 to slide on the first slideway section 614*c*, and hardly acts as a force that pivots the door cover-side member 1614.

Therefore, during the course of the side-face cover 1015 being opened from the state shown in FIG. 17 to the state shown in FIG. 18, the first sliding member 1615 slides on the first slideway section 1614*c* in association with the opening motion of the side-face cover 1015. Meanwhile, the resistance exerted by the frictional force produced by sliding of the first sliding member 615 acts on the side-face cover 1015 by way of the shaft D 1615*a*. Put another way, by way of the shaft D 1615*a*, the side-face cover 1015 receives the resistance in the sliding direction exerted by the frictional force produced by sliding of the first sliding member 1615.

In the state where the sliding direction intersects with the virtual line connecting the coupling shaft 1015*a* and the shaft D 1615*a* at a large angle (see FIGS. 17 and 18), the force exerted on the shaft D 1615*a* in the sliding direction acts as a resistance against the opening motion of the side-face cover 1015. Accordingly, even when the user releases his/her hand from the side-face cover 1015 after the pressure exerted on the pressing roller 1930 by the tension spring 1960 has been released, the first sliding member 1615 slides slowly. Thus, the side-face cover 1015 does not burst open.

Figure 19:
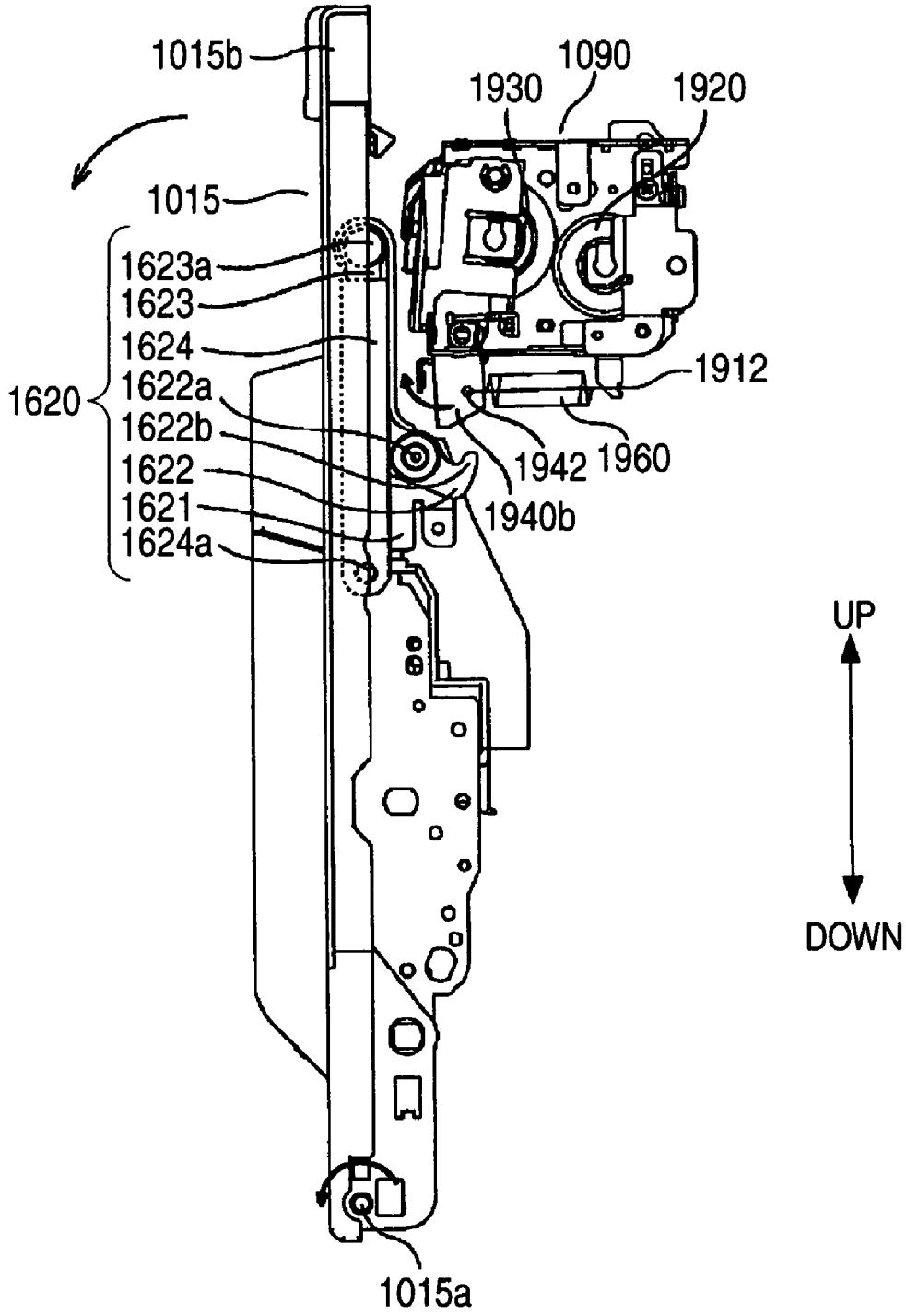
FIG. 19 is a view illustrating a second arm 1620 with the side-face cover 1015 closed.
Figure 20:
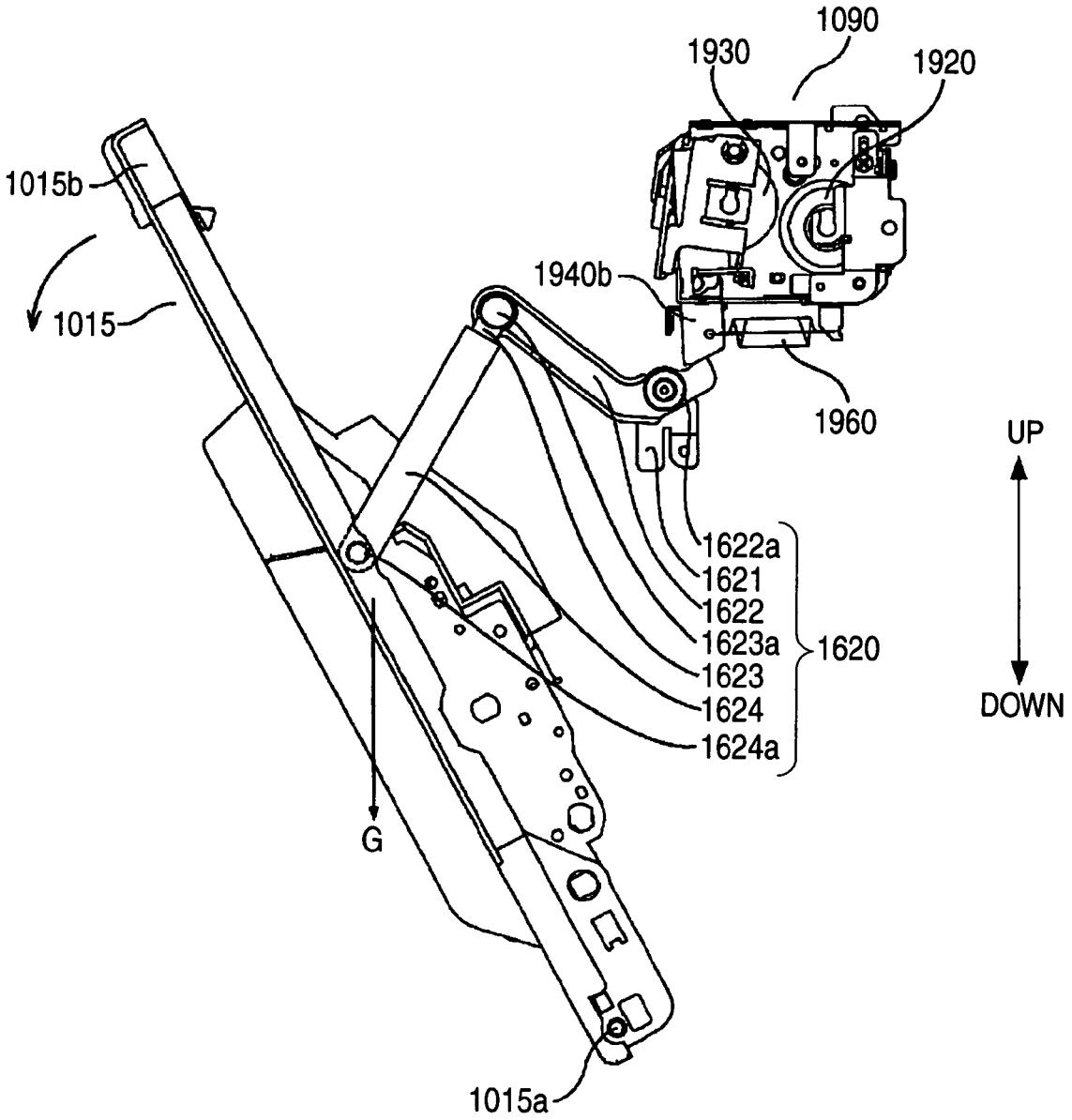
FIG. 20 is a view illustrating the second arm 1620 with the pressure exerted by the tension spring 1960 being released.
Figure 21:
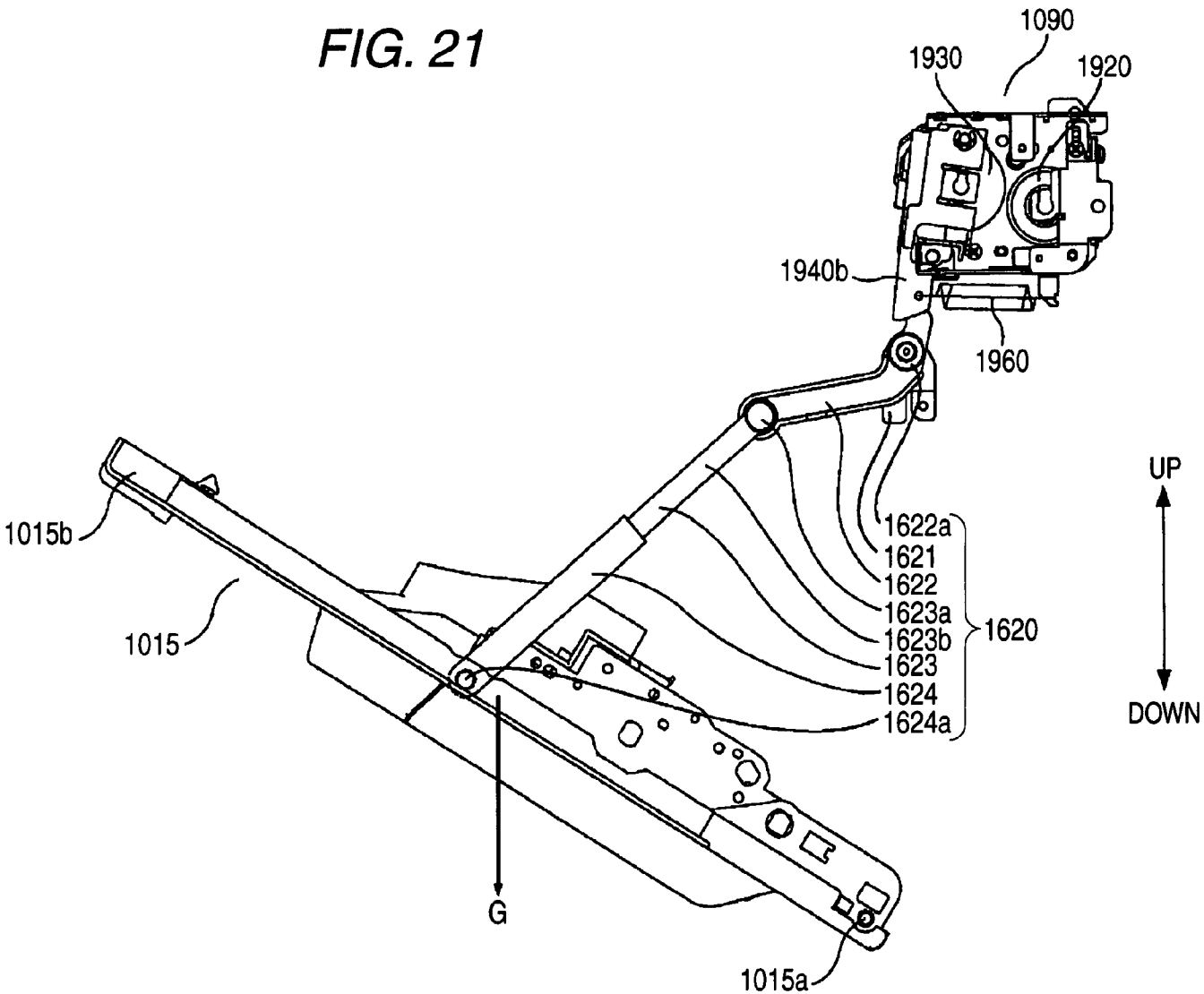
FIG. 21 is a view illustrating the second arm 1620 with the side-face cover 1015 fully open.

The configuration of the second arm 1620 will be described by reference to FIGS. 19 to 21. Meanwhile, FIGS. 19 to 21 are diagrams as viewed from the rear (see FIG. 11) of the printer 1010.

The second arm 1620 transmits a force exerted on the side-face cover 1015 to the pressing lever 1940*b* of the fixing unit 1090. The second arm 1620 has a fixed member 1621 fixed on the frame (not shown) of the printer main body 1010*a*, a second lever abutting member 1622, an intermediate member 1623, and a second sliding member 1624 which serves as a sliding section.

The second lever abutting member 1622 is pivotably supported about a shaft F 1622*a* in relation to the fixed member 1621 fixed on the frame (not shown) of the printer main body 1010*a*. A second lever abutting section 1622*b*, which can be brought into contact with the pressure lever 1940*b*, is disposed at one end of the second lever abutting member 1622. In addition, the second lever abutting member 1622 is pivotably coupled to a shaft G 1623*a* at the other end.

The intermediate member 1623 is coupled, at one end thereof, to the shaft G 1623*a*, which is coupled to the second lever abutting member 1622. As a result, the intermediate member 1623 can pivot about the shaft G 1623*a* in relation to the second lever abutting member 1622. In addition, a second slideway section 1623*b* (see FIG. 21) is disposed at the other end of the intermediate member 1623.

The second sliding member 1624 slides on the second slideway section 623*b*. The second sliding member 1624 is restricted in its motion by the second slideway section 1623*b* so as to slide only in a predetermined direction (hereinafter called a "sliding direction") on the second slideway section 1623*b*. However, a force in the sliding direction can be transmitted between the second sliding member 1624 and the second slideway section 1623*b* in the form of a static frictional force that acts between the second sliding member 1624 and the second slideway section 1623*b*. In addition, the second sliding member 1624 is pivotably coupled to a shaft H 1624*a* supported on the side-face cover 1015. Meanwhile, each of the second sliding member 1624 and the second slideway section 1623*b* is made of a metal.

Of the second arm 1620 is formed by means of coupling a plurality of linkages, more specifically, the second lever abutting member 1622 and the intermediate member 1623. In addition, as described above, each of the linkages, more specifically, the second lever abutting member 1622 and the intermediate member 1623, can pivot when the side-face cover 1015 opens/closes.

Meanwhile, the shaft F 1622*a*, which is fixed onto the printer main body 1010*a*, does not move at the time the side-face cover 1015 opens/closes. In contrast, the shaft H 1624*a*, which is supported on the side-face cover 1015, moves along with opening/closing of the side-face cover 1015. In addition, the shaft G 1624*a*, which is not fixed, can move along with opening/closing of the side-face cover 1015.

When a user, or the like, opens the side-face cover 1015 so as to remove a medium jammed in the printer 1010, first, the second arm 1620 releases the pressure exerted on the pressing roller 1930 by the tension spring 1960 in association with the opening motion of the side-face cover 1015. After the pressure exerted on the pressing roller 1930 by the tension spring 1960 has been released, the second sliding member 1624 slides on the second slideway section 1623*b* in association with the opening motion of the side-face cover 1015. Hereinbelow, operations the second arm 1620 at the time the side-face cover 1015 is opened will be described by reference to FIGS. 19 to 21.

As shown in FIG. 19, in the state where the side-face cover 1015 is closed, the second arm 1620 (i.e., the second lever abutting member 1622, the intermediate member 1623, and the second sliding member 1624) is folded so as to be compact in size. Under such a condition, the second lever abutting section 1622*b* of the second lever abutting member 1622 is not in contact with the pressing lever 1940*b* (even when the abutting occurs, only to a slight extent). Therefore, the spring latch 1942 of the pressing lever 1940*b* gripping the pressing roller 1930 is pulled by the tension spring 1960 toward the spring latch 1912 on the frame 1910. Thus, as shown in FIG. 19, the pressing roller 1930 is pressed into contact against the fixing roller 1920 by the tensile force of the tension spring 1960.

When a user, or the like, standing by the right side face (see FIG. 11) of the printer 1010 pulls the tab 1015*b* of the closed side-face cover 1015, the side-face cover 1015 pivots about the coupling shaft 1015*a*. Along with counterclockwise rotation (in a direction indicated by the arrow in FIG. 19) of the side-face cover 1015, the shaft H 1624*a* supported on the side-face cover 1015 pivots about the coupling shaft 1015*a*.

Along with the motion of the shaft H 1624*a*, the second sliding member 1624 coupled to the shaft H 1624*a* moves. Along with the motion of the second sliding member 1624, the intermediate member 1623 moves. At this time, the second lever abutting member 1622 receives a force in the sliding direction from the intermediate member 1623 by way of the shaft G 1623*a*, thereby pivoting counterclockwise in FIG. 19 about the shaft F 1622*a*. Subsequently, immediately after the side-face cover 1015 starts to open, the second lever abutting section 1622*b* of the second lever abutting member 1622 comes into contact with the pressing lever 1940*b*.

When the second lever abutting section 1622*b* of the second lever abutting member 1622 comes into contact with the pressing lever 1940*b*, the side-face cover 1015 receives a force in the sliding direction on the shaft H 1624*a* exerted by the tensile force of the tension spring 1960 (the static frictional force that acts between the second sliding member 1624 and the second slideway section 1623*b* is larger than this force). Accordingly, the tensile force of the tension spring acts on the side-face cover 1015 as a force in the direction that closes the side-face cover 1015.

Therefore, when the user further opens the side-face cover 1015 after the second lever abutting section 1622*b* has been brought into contact with the pressing lever 1940*b*, the user receives, against the direction that opens the side-face cover 1015, a resistance exerted by the tensile force of the tension spring 1960. In addition, an own weight G of the side face cover 1015 acts in the direction that opens the side-face cover 1015. However, in a state where the side-face cover 1015 is open narrow, an action force exerted by the own weight G of the side-face cover 1015 is small. Accordingly, even when the user releases his/her hand from the side-face cover 1015 at this time, the side-face cover 1015 does not burst open.

When the side-face cover 1015 is further opened against the tensile force of the tension spring 1960, the force with which the second lever abutting section 1622*b* presses the pressing lever 1940*b* exceeds the tensile force of the tension spring 1960, whereby the pressing lever 1940*b* pivots clockwise (the direction indicated by the arrow in FIG. 19) about the frame shaft 1911. When the pressing lever 1940*b* gripping the pressing roller 1930 has pivoted to assume a state indicated in FIG. 20, the pressing roller 1930 is separated from the fixing roller 1920. More specifically, the pressure exerted on the pressing roller 1930 by the tension spring 1960 is released.

Meanwhile, in the duration between the time the second lever abutting section 1622*b* has made contact with the pressing lever 1940*b* and the time the pressure exerted on the pressing roller 1930 by the tension spring 1960 is released, the second sliding member 1624 hardly slides on the second slideway section 1623*b*.

When the side-face cover 1015 is further opened after the pressure exerted on the pressing roller 1930 by the tension spring 1960 has been released, the force that acts between the second sliding member 1624 and the second slideway section 1623*b* exceeds the static frictional force. Accordingly, the second sliding member 1624 slides on the second slideway section 1623*b*. At this time, a dynamic frictional force acts between the second sliding member 1624 and the second slideway section 1623*b*. In the present embodiment, this dynamic frictional force serves as the resistance against the opening motion of the side-face cover 1015.

Therefore, during the course of the side-face cover 1015 being opened from the state shown in FIG. 20 to the state shown in FIG. 21, the second sliding member 1624 slides on the second slideway section 1623*b* in association with the opening motion of the side-face cover 1015. Meanwhile, the resistance exerted by the dynamic frictional force produced by sliding of the second sliding member 1624 acts on the side-face cover 1015 by way of the shaft H 1624*a*. Put another way, by way of the shaft H 1624*a*, the side-face cover 1015 receives the resistance exerted by the frictional force produced by sliding of the second sliding member 1624 in the sliding direction.

In the state where the sliding direction intersects with the virtual line connecting the coupling shaft 1015*a* and the shaft H 1624*a* at a large angle (see FIGS. 20 and 21), the force exerted on the shaft H 1624*a* in the sliding direction acts as a resistance against the opening motion of the side-face cover 1015. Accordingly, even when the user releases his/her hand from the side-face cover 1015 after the pressure exerted on the pressing roller 1930 by the tension spring 1960 has been released, the second sliding member 1624 slides slowly. Thus, the side-face cover 1015 does not burst open.

Meanwhile, in the above descriptions, the operations of the first arm 1610 and those of the second arm 1620 have been explained separately. However, when the side-face cover 1015 opens, the first arm 1610 and the second arm 1620 start their operations at the same timing.

As described above, the connecting member for coupling the side-face cover 1015 and the fixing unit 1090 has the pressure-releasing section and the sliding section. By virtue of the configuration, there can be realized the printer 1010 offering facilitated removal of a jammed medium by a user, or the like, as well as suppression of an impact imparted on the printer 1010 at the time when the side-face cover 1015 is opened. Hereinbelow, detailed descriptions will be provided.

In the printer 1010, the pressure exerted on the pressing roller 1930 by the tension spring 1960 is desirably released before the side-face cover 1015 becomes fully opened. The reason therefor is that a user, or the like, sometimes attempts to remove a jammed medium in a half-open state before the side-face cover 1015 becomes fully opened.

Meanwhile, when the connecting member releases the pressure on the pressing roller 1930 exerted by the tension spring 1960, the pressing force of the tension spring 1960 serves as a resistance. Thus, a resistance is exerted against a direction that opens the side-face cover 1015, thereby preventing the side-face cover 1015 from bursting open. However, when the pressure is released before the side-face cover 1015 is fully opened, the resistance against the opening motion of the side-face cover 1015 acts no more after release of the pressure. Consequently, in some cases the side-face cover 1015 bursts open. When the side-face cover 1015 bursts open, an impact imparted on the printer 1010 is increased, which may adversely affect other components, or the like. Therefore, the impact imparted on the printer 1010 at the time the door cover is opened is desirably suppressed.

Accordingly, in the present embodiment, the connecting member (e.g., the first arm 1610) has the pressure releasing section (for the first arm 1610, the first lever abutting member 1612, the lever side member 1613, and the door cover side member 1614) for releasing the pressure exerted by the tension spring 1960 on the pressing roller 1930 in association with the opening motion of the side-face cover 1015, and the sliding section (for the first arm 1610, the first sliding member 1615) which slides on the pressure releasing section in association with the opening motion of the side-face cover 1015 after the pressure against the pressing roller 1930 has been released (see FIG. 18). Hereinbelow, the specific descriptions will be provided by reference to the first arm 1610.

In the present embodiment, before the side-face cover 1015 becomes fully opened (i.e., before a medium jammed in the printer 1010 is removed), the pressure releasing member (the first lever abutting member 1612, the lever-side member 1613, and the door cover-side member 1614) releases the pressure exerted on the pressing roller 1930 by the tension spring 1960 in association with the opening motion of the side-face cover 1015. When the pressure exerted on the pressing roller 1930 by the tension spring 1960 is released as described above, the medium can be removed even when the side-face cover 1015 is half open. Accordingly, there can be realized the printer 1010 that offers facilitated removal of a jammed medium by a user, or the like.

In addition, when the first sliding member 1615 slides on the first slideway section 1614*c* in association with the opening motion of the side-face cover 1015 after the pressure exerted on the pressing roller 1930 has been released, a friction stemming from sliding of the sliding section acts on the side-face cover 1015. This force serves as the resistance against the opening motion of the side-face cover 1015. As a result, after the pressure exerted on the pressing roller 1930 has been released, the sliding section slides slowly. Thus, the side-face cover 1015 does not burst open, thereby suppressing the impact imparted on the printer 1010.

As described above, when the connecting member has the pressure releasing section and the sliding section, there can be realized the printer 1010 offering facilitated removal of a jammed medium by a user, or the like, as well as suppression of an impact imparted on the printer 1010 at the time the side-face cover 1015 is opened.

The image forming apparatus, and the like, according to the present invention has hitherto been described by reference to the embodiment. However, the above-described embodiment of the invention aims at facilitating understanding of the invention, and should not be construed as limiting the range of the invention. As a matter of course, the invention can be changed and modified without departing from the scope of the invention, and equivalents thereof are included in the invention.

In the above embodiment, the following configuration has been employed. Namely, the printer 1010 (the image forming apparatus) has the openable side-face cover 1015 (the door cover), the fixing unit 1090, and the connecting member (e.g., the first arm 1610) for coupling the side-face cover 1015 and the fixing unit 1090. The fixing unit 1090 has the fixing roller 1920 and the pressing roller 1930, which can hold a medium therebetween, and the tension spring 1960 for pressing the pressing roller 1930 against the fixing roller 1920. In a state where the side-face cover 1015 is closed, a toner image on the medium is held between the fixing roller 1920 and the pressing roller 1930, which is pressed by the tension spring 1960. The connecting member has the pressure releasing section (e.g., for the first arm 1610, the first lever abutting member 1612, the lever-side-member 1613, and the door cover-side member 1614) for releasing the pressure exerted by the tension spring 1960 in association with the opening motion of the side-face cover 1015, and the sliding section (e.g., for the first arm 1610, the first sliding member 1615) which slides in relation to the pressure-releasing section in association with the opening motion of the side-face cover 1015 after the pressure has been released.

Meanwhile, in the above embodiment, an example where the image forming apparatus is a full-color laser beam printer of an intermediate-transfer type has been described. However, the invention can be applied to image forming apparatuses of various kinds, such as a full-color laser beam printer of a type other than the intermediate-transfer type, a monochrome laser beam printer, a copier, or a facsimile.

Meanwhile, the above embodiment has been described while taking the image forming apparatus provided with rotary-type development devices as an example, however, the invention is not limited thereto. The invention can also be applied to, e.g., an image forming apparatus provided with a tandem-type development device.

Meanwhile, in the above embodiment, there has been described an example where the photosensitive member, which is as an image carrier, is configured such that a photosensitive layer is provide on a peripheral surface of a cylindrical, conductive substrate, however, the invention is not limited thereto. For instance, the photosensitive member may be, e.g., a so-called photosensitive belt which is configured by means of forming a photosensitive layer on the surface of a belt-shaped conductive substrate.

Meanwhile, the above embodiment has been described on an assumption that the fixing roller 1920 heats the toner image on the medium. However, another configuration in which the fixing roller 1920 does not heat the toner image may be adopted. In this case, the toner image on the medium is fixed by the pressure between the fixing roller 1920 and the pressing roller 1930. However, when the fixing roller 1920 heats the toner image, fixation of the toner image can be effected immediately. Therefore, the embodiment is more desirable.

Furthermore, in the embodiment, as shown in FIG. 15A, each of the fixing roller 1920 and the pressing roller 1930 is a rotatable roller, however, the invention is not limited thereto. For instance, there can be adopted such a configuration that at least one of the fixing roller 1920 and the pressing roller 1930 is a rotatable belt.

However, in a case where the fixing roller 1920 and the pressing roller 1930 are the rotatable rollers, the pressing force exerted on the pressing roller 1930 by the tension spring 1960 is desirably set to a large value so as to enhance a fixing force. Meanwhile, when the pressing force is large, the need for releasing the pressure exerted on the pressing roller 1930 by the tension spring 1960 for removal of a medium jammed in the printer 1010 further increases. Accordingly, when the printer 1010 has the above-described pressure releasing section, there is yielded the effect of realizing the printer 1010 from which a user, or the like, can easily remove a jammed medium. Therefore, the embodiment is more preferable.

Furthermore, as shown in FIG. 15A, the embodiment has been described that the tension spring 1960 is a spring member. However, the invention is not limited thereto.

However, when the tension spring 1960 is a spring member, the pressing force can be adjusted easily. Therefore, the tension spring 1960 can press the pressing roller 1930 with an appropriate pressing force. Therefore, the embodiment is more preferable.

In the embodiment, an example where the tension spring 1960 is employed. However, the invention is not limited thereto, and, e.g., a compression spring may be employed.

Furthermore, as shown in FIGS. 16 and 19, in the embodiment, the pressure releasing section is formed by means of coupling a plurality of linkages (for the first arm 1610, the first lever abutting member 1612, the lever-side member 1613, and the door cover-side member 1614; for the second arm 1620, the second lever abutting member 1622 and the intermediate member 1623), and each of the linkages can pivot. However, the invention is not limited thereto. For instance, the pressure releasing section may be formed from a single member.

Furthermore, as shown in FIGS. 16 and 19, in the embodiment, the sliding section (for the first arm 1610, the first sliding member 1615; and for the second arm 1620, the second sliding member 1624) is made of a metal, however, the invention is not limited thereto. For instance, the sliding section may be made of a resin.

However, when the sliding section is made of a metal, as compared with the case where the sliding section is made of a resin, a friction stemming from sliding of the sliding section is increased. As a result, a braking effect produced at the time when the side-face cover 1015 is opened is exerted more remarkably. Therefore, when the sliding section is made of a metal, the impact imparted on the image forming apparatus at the time the side-face cover 1015 is opened can be suppressed more effectively. Therefore, the embodiment is more preferable.

Furthermore, as shown in FIGS. 16 and 19, in the embodiment, the number of the connecting members (the first arm 1610 and the second arm 1620) is two, however, the invention is not limited thereto. For instance, the number of the connecting member may be one.

However, when the number of the connecting members is two, as compared with the case where the number of the connecting member is one, the side-face cover 1015 can be supported more stably. Consequently, the impact imparted to the image forming apparatus when the side-face cover 1015 is opened can be suppressed more effectively. Therefore, the embodiment is more preferable.

Furthermore, as shown in FIG. 12 in the embodiment, the side-face cover 1015 has the medium-transport mechanism (the registration rollers 1096, the motor, and the guide plate) for transporting a medium. However, the invention is not limited thereto. For instance, it may be the case that the side-face cover 1015 does not have the medium-transporting mechanism.

However, when the side-face cover 1015 has the medium-transporting mechanism, the side-face cover 1015 is increased in its own weight G (see FIG. 17, and the like). Since the thus-increased own weight G acts in the direction that opens the side-face cover 1015, the possibility that the side-face cover 1015 burst opens with higher momentum increases. Therefore, when the side-face cover 1015 has the medium-transporting mechanism, the effect of suppressing the impact imparted on the printer 1010 when the side-face cover 1015 is opened can be exerted more effectively. Therefore, the embodiment is more preferable.

Furthermore, in the embodiment, as shown in FIG. 12, the side-face cover 1015 has, at a vertically-lower portion thereof, the coupling shaft 1015*a* (the coupling section) supported on the printer main body 1010*a* (the image forming apparatus main body), and opens/closes about the coupling shaft 1015*a* serving as a pivot. However, the invention is not limited thereto. For instance, the side-face cover 1015 may have, at a vertically-lower portion thereof, the coupling shaft.

However, when the side-face cover 1015 opens/closes about the coupling shaft 1015*a* disposed at a vertically lower portion, there arises the possibility that the side-face cover 1015 bursts open with higher momentum by the force of the own weight G, whereby the impact exerted on the printer 1010 may be increased. Therefore, when the side-face cover 1015 has the coupling shaft 1015*a* disposed at a vertically lower portion and opens/closes about the coupling shaft 1015*a*, the effect of suppressing the impact imparted on the printer 1010 when the side-face cover 1015 is opened can be exerted more effectively. Therefore, the embodiment is more preferable.

Furthermore, in the embodiment, as shown in FIGS. 16 to 18, a sliding distance of the sliding section in relation to the pressure releasing section is larger in a duration ranging from a state where the side-face cover 1015 is closed until release of the pressure exerted by the tension spring 1960 than in a duration ranging from release of the pressure exerted by the tension spring 1960 until when the side-face cover 1015 is fully opened.

However, in the above-described case, until the pressure is released by the pressure releasing member (e.g., the first lever abutting member 1612, the lever-side member 1613, and the door cover-side member 1614), the resistance produced by sliding of the sliding section can be circumvented, thereby enabling smooth opening of the side-face cover 1015. Therefore, the embodiment is more preferable.

Next, an embodiment of an image forming system, serving as an example embodiment according to the invention, will be described by reference to FIGS. 22 and 23.

Figure 22:
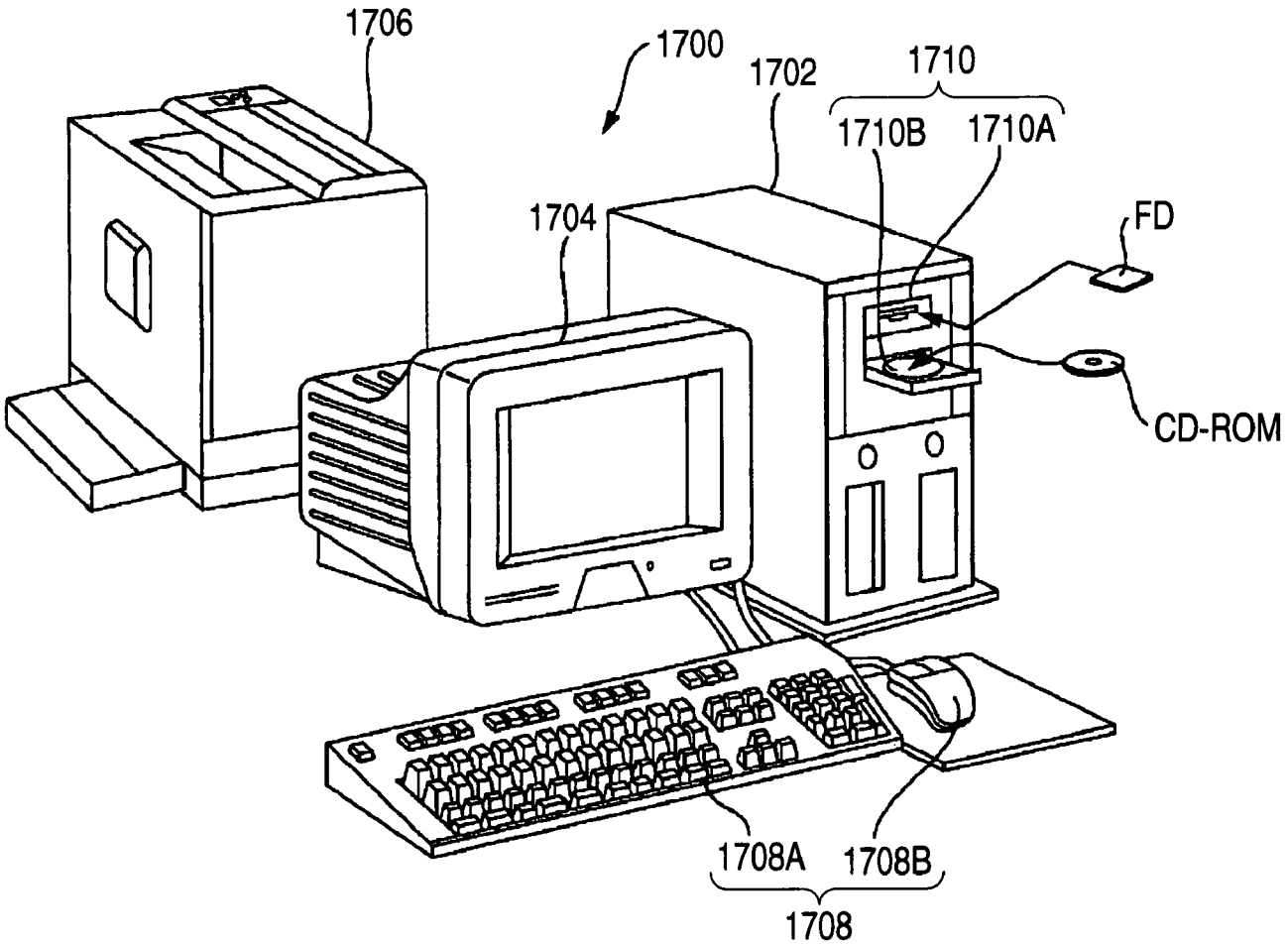
FIG. 22 is an explanatory view illustrating an external configuration of the image forming system.

In FIG. 22, the image forming system 1700 has a computer 1702, a display device 1704, the printer 1010, an input device 1708, and a reader 1710.

The computer of the present embodiment is enclosed in a mini-tower-type enclosure. However, the invention is not limited thereto. As the display device 1704, a CRT (cathode ray tube), a plasma display, a liquid crystal display device, or the like, is generally employed. However, the invention is not limited thereto. As the printer 1010, the printer having hitherto been described is employed. As the input device 1708, a keyboard 1708A and a mouse 1708B are employed in the embodiment. However, no limitation is imposed thereto. As the reader 1710, a flexible disk drive device 1710A and a CD-ROM drive device 1710B are employed in the embodiment. However, the invention is not limited thereto, and, e.g., another device, such as an MO (magneto optical) drive device, or a DVD (digital versatile disk), may be employed.

Figure 23:
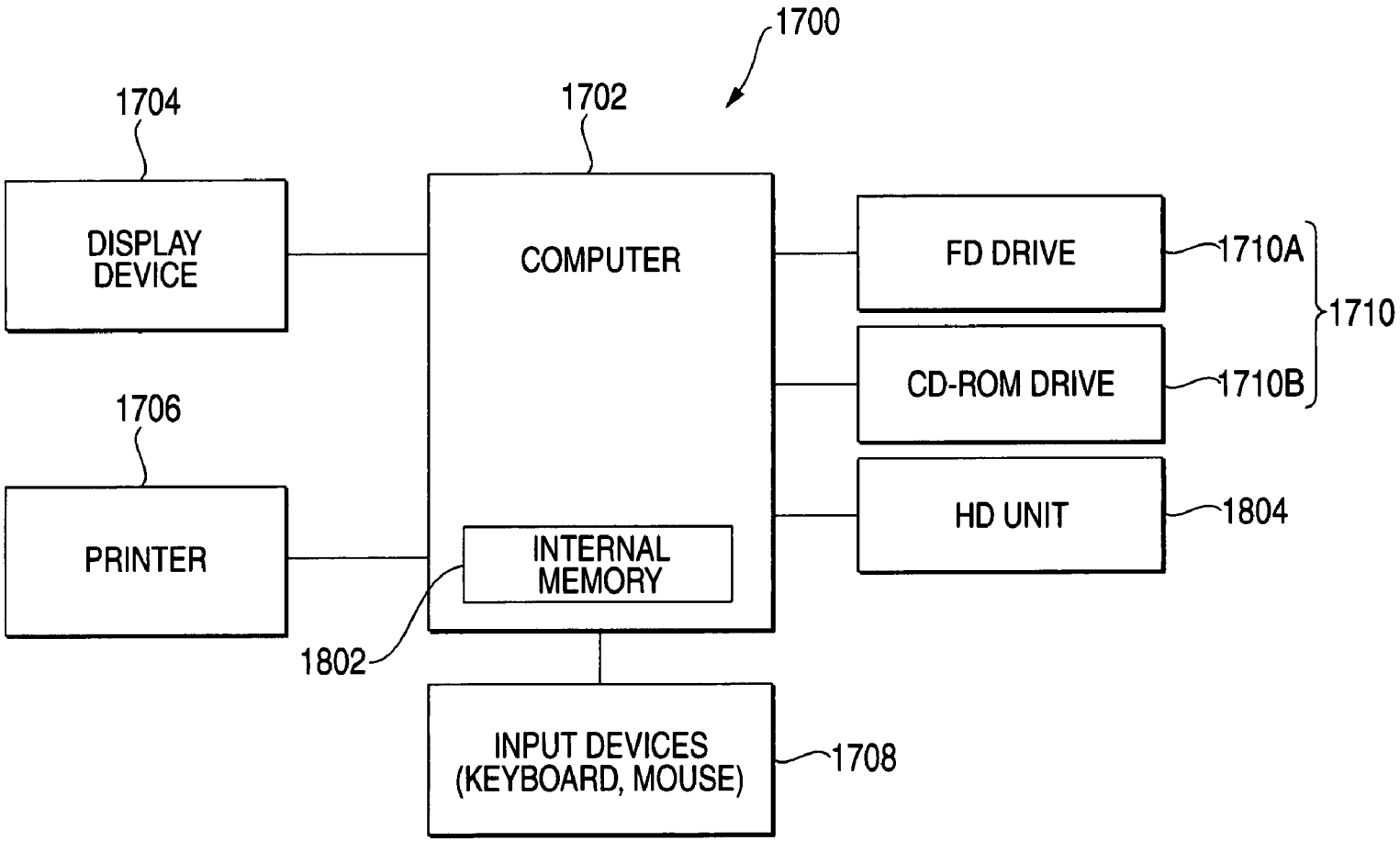
FIG. 23 is a block diagram illustrating the configuration of the image forming system shown in FIG. 22.

As shown in FIG. 23, in the enclosure, in which the computer 1702 is enclosed, an internal memory 1802, such as RAM, and an external memory, such as a hard disk drive unit 1804, are further disposed.

Meanwhile, in the above descriptions, an example where the printer 1010 is connected to the computer 1702, the display device 1704, the input device 1708, and the reader 1710, thereby forming the image forming system, has been provided. However, the invention is not limited thereto. For instance, the image forming system may be formed from the computer 1702 and the printer 1010, wherein the image forming system does not include any of the display device 1704, the input device 1708, and the reader 1710.

Alternatively, e.g., the printer 1010 may include a portion of each function or mechanism of the computer 1702, the display device 1704, the input device 1708, and the reader 1710. As an example configuration, the printer 1010 may include an image forming section for effecting image processing, a display section for performing a variety of display operations, a recording-medium-attachment/detachment section for attaching/detaching a recording medium in which image data captured by a digital camera, or the like, are recorded, and the like.

The image forming system realized as described above achieves a system superior to the related-art system in terms of the overall system.

What is claimed is:

1. An image forming apparatus comprising:

a housing body including a first part forming a part of a first transporting path in which a medium is transported;

an image forming unit accommodated in the housing body and adapted to form an image onto at least one face of the medium;

a door cover attached to the housing body, the door cover including a second part adapted to face the first part when the door cover is closed, thereby forming the part of the first transporting path together with the first part; and a double-sided transporting unit/medium reversal unit detachably mounted to the second part and facing the first part including a second transporting path, the second transporting path connected to the first transporting path and adapted to transport the medium while turning inside out so that the image forming unit forms images on both sides of the medium.

2. The image forming apparatus according to claim 1, wherein the first part is provided with a first roller, the first roller faces the first transporting path, the second part includes a space for mounting the double-sided transporting unit/medium reversal unit and is provided with a second roller at a portion other than the space, the second roller faces the first transporting path, and the space is adapted to receive a covering member in place of the double-sided transporting unit/medium reversal unit when the image forming apparatus is configured to perform only a single-sided printing.

3. An image forming apparatus comprising:

a housing body including a first part and a first transporting path in which a medium is transported;

an image forming unit accommodated in the housing body and adapted to form an image onto at least one face of the medium;

a door cover including a second part attached to the housing body, the door cover including a third part and a fourth part, a double-sided transporting unit/medium reversal unit detachably mounted to the fourth part and including a second transporting path, the second transporting path connected to the first transporting path and adapted to transport the medium while turning inside out so that the image forming unit forms images on both sides of the medium; and a manual feeding unit comprised of the first part and the third part, the manual feeding unit including a third transporting path connected to the first transporting path and adapted to manually feed the medium to the image forming unit, wherein the third part is arranged between the second part and the fourth part.

4. The image forming apparatus according to claim 3, wherein the fourth part is adapted to face the housing body when the door cover is closed.

5. The image forming apparatus according to claim 2, wherein the space is adapted to alternatively receive a covering member and the double-sided transporting unit/medium reversal unit.

6. The image forming apparatus according to claim 2, wherein the double-sided transporting unit/medium reversal unit is to be installed from the inside of the cover door in the space.

* * * * *